US011548536B1

(12) United States Patent
Anderson et al.

(10) Patent No.: US 11,548,536 B1
(45) Date of Patent: Jan. 10, 2023

(54) RAILROAD CAR VENTED HATCH COVER ASSEMBLY INCLUDING A REPLACEABLE COMBINED VENTED HATCH COVER PROTECTOR AND GASKET

(71) Applicant: Transportation IP Holdings, LLC, Norwalk, CT (US)

(72) Inventors: John D. Anderson, Oswego, IL (US); Walter J. Peach, Montgomery, IL (US)

(73) Assignee: Transportation IP Holdings, LLC, Norwalk, CT (US)

( * ) Notice: Subject to any disclaimer, the term of this patent is extended or adjusted under 35 U.S.C. 154(b) by 907 days.

(21) Appl. No.: 16/380,033

(22) Filed: Apr. 10, 2019

Related U.S. Application Data

(60) Provisional application No. 62/698,400, filed on Jul. 16, 2018, provisional application No. 62/662,997, filed on Apr. 26, 2018.

(51) Int. Cl.

| | |
|---|---|
| ***B61D 5/00*** | (2006.01) |
| ***B65D 90/00*** | (2006.01) |
| ***B65D 90/10*** | (2006.01) |
| ***B65D 90/34*** | (2006.01) |
| *B61D 7/00* | (2006.01) |
| *B61D 17/16* | (2006.01) |

(52) U.S. Cl.
CPC ..... *B61D 5/08* (2013.01); *B65D 90/10* (2013.01); *B65D 90/34* (2013.01); *B61D 7/00* (2013.01); *B61D 17/16* (2013.01)

(58) Field of Classification Search
CPC . B61D 5/08; B61D 7/00; B61D 17/16; B65D 90/10; B65D 90/34
See application file for complete search history.

(56) References Cited

U.S. PATENT DOCUMENTS

| | | | |
|---|---|---|---|
| 1,072,164 | A | 9/1913 | Posson |
| 2,231,885 | A | 2/1941 | Christy |
| 2,333,619 | A | 11/1943 | Swanson |
| 2,360,533 | A | 10/1944 | Zeidler |
| 2,600,947 | A | 6/1952 | Wagner |
| 2,776,070 | A | 1/1957 | Phillips |
| 3,476,042 | A | 11/1969 | Carney, Jr. et al. |
| 3,606,070 | A | 9/1971 | Shepherd |
| 4,189,262 | A | 2/1980 | Anderson |
| 4,248,160 | A | 2/1981 | Carney et al. |
| 4,273,064 | A | 6/1981 | Sutton |
| 4,644,874 | A | 2/1987 | Kleykamp |
| 4,819,830 | A | 4/1989 | Schultz |
| 5,011,038 | A | 4/1991 | Schultz |
| 5,035,185 | A | 7/1991 | Schultz |

(Continued)

*Primary Examiner* — Robert J McGarry, Jr.
(74) *Attorney, Agent, or Firm* — McCoy Russell LLP

(57) ABSTRACT

A railroad car hatch cover assembly including a replaceable combined hatch cover protector and gasket that can be quickly and easily mounted to a hatch cover of the vented hatch cover assembly and easily and quickly removed therefrom. In certain embodiments, the combined hatch cover protector and gasket includes an outer sealing member configured to be positioned in a pocket of the hatch cover, an inner protector element holder, a protector element held by and secured to the protector element holder, and a dual connector connecting the outer sealing member and the inner protector element holder, and configured to partially facilitate connection to the hatch cover.

31 Claims, 20 Drawing Sheets

(56) References Cited

U.S. PATENT DOCUMENTS

| | | | | |
|---|---|---|---|---|
| 5,060,579 | A | 10/1991 | Johnson et al. | |
| 5,064,089 | A | 11/1991 | Schultz | |
| 5,158,022 | A | 10/1992 | Dugge et al. | |
| 5,239,772 | A | 8/1993 | Burian et al. | |
| D340,207 | S | 10/1993 | Schultz | |
| 5,438,935 | A | 8/1995 | Seitz | |
| 5,622,117 | A | 4/1997 | Burian et al. | |
| 5,628,254 | A | 5/1997 | Ott et al. | |
| 5,644,990 | A | 7/1997 | Seitz | |
| 5,678,827 | A | 10/1997 | Burian et al. | |
| 5,738,396 | A | 4/1998 | Oestermeyer et al. | |
| 5,785,078 | A | 7/1998 | Burian et al. | |
| 5,794,539 | A | 8/1998 | Ott et al. | |
| 5,813,352 | A * | 9/1998 | Bramlett | F16J 13/16 220/372 |
| 5,960,980 | A * | 10/1999 | Burke | B61D 17/16 277/645 |
| 6,050,199 | A * | 4/2000 | Anderson | B61D 17/16 105/377.07 |
| 6,053,113 | A | 4/2000 | Shaddle | |
| 6,076,471 | A | 6/2000 | Burian et al. | |
| 6,085,664 | A | 7/2000 | Early | |
| 6,216,603 | B1 | 4/2001 | Shaddle | |
| 6,296,135 | B1 | 10/2001 | Anderson et al. | |
| 6,494,338 | B1 | 12/2002 | Schultz | |
| 6,607,177 | B2 | 8/2003 | Burian et al. | |
| 6,616,123 | B2 | 9/2003 | Burian et al. | |
| 7,165,789 | B2 | 1/2007 | Burian et al. | |
| 7,207,602 | B2 | 4/2007 | Burian et al. | |
| 7,703,630 | B2 * | 4/2010 | Degutis | B61D 17/16 220/372 |
| 8,060,264 | B2 * | 11/2011 | Oestermeyer | B65D 90/32 701/19 |
| 8,166,891 | B2 | 5/2012 | Borowski et al. | |
| 8,656,840 | B2 | 2/2014 | Borowski et al. | |
| 8,894,102 | B2 | 11/2014 | Degutis et al. | |
| 8,950,618 | B2 | 2/2015 | Degutis et al. | |
| 9,194,522 | B2 | 11/2015 | Dzolovic et al. | |
| D752,199 | S | 3/2016 | Berkman et al. | |
| 9,493,172 | B2 | 11/2016 | McLaughlin et al. | |
| 9,494,269 | B2 | 11/2016 | Oliver et al. | |
| 9,592,837 | B2 | 3/2017 | McLaughlin et al. | |
| 9,631,762 | B2 | 4/2017 | Oliver et al. | |
| 9,637,142 | B2 | 5/2017 | Reiling et al. | |
| 9,709,370 | B1 | 7/2017 | Keller | |
| 2008/0029011 | A1 | 2/2008 | Czarnowski et al. | |
| 2009/0158959 | A1 | 6/2009 | Schultz et al. | |
| 2010/0224624 | A1 | 9/2010 | Gonzalez | |
| 2014/0260940 | A1 | 9/2014 | Obyle et al. | |
| 2014/0345493 | A1 | 11/2014 | Skibinski | |
| 2014/0360805 | A1 | 12/2014 | Berkman et al. | |
| 2015/0139476 | A1 | 5/2015 | Yu | |
| 2017/0203828 | A1 | 7/2017 | Viaud et al. | |
| 2017/0225694 | A1 | 8/2017 | Sandheinrich et al. | |
| 2019/0112867 | A1 | 4/2019 | Warren | |
| 2019/0161096 | A1 | 5/2019 | Warren | |
| 2019/0218025 | A1 | 7/2019 | Craig | |

* cited by examiner

RAILROAD CAR VENTED HATCH COVER ASSEMBLY INCLUDING A REPLACEABLE COMBINED VENTED HATCH COVER PROTECTOR AND GASKET

PRIORITY CLAIM

This application claims priority to and the benefit of U.S. Provisional Patent Application No. 62/662,997, filed Apr. 26, 2018, and U.S. Provisional Patent Application No. 62/698,400, filed Jul. 16, 2018, the entire contents of both of which are incorporated herein by reference.

CROSS-REFERENCE TO RELATED APPLICATIONS

This application is related to the following commonly owned co-pending patent application: U.S. application Ser. No. 29/645,472, entitled "RAILROAD CAR COMBINED VENTED HATCH COVER PROTECTOR AND GASKET".

BACKGROUND

Various different types of hopper railroad cars are well known. Hopper railroad cars are typically used to transport loose bulk commodities or loose materials (such as but not limited to plastic pellets, powder, and other granular or similar materials). The two main types of hopper railroad cars are covered hopper cars that include full side walls and a roof, and open hopper cars that do not have a roof.

Various known covered hopper railroad cars have multiple separate interior compartments, outlets at the bottom of the hopper railroad car for each compartment (such as a single separate outlet for each compartment), and inlets at the top of the hopper railroad car for each compartment (such as one or more separate inlets for each compartment). Each inlet at the top of each compartment enables that compartment to be filled, and enables air to flow into that compartment as material flows out of the outlet at the bottom of that compartment during unloading of the compartment. For example, one type of known hopper railroad car includes four compartments, one outlet at the bottom of each compartment, and two or three inlets at the top of each compartment. Vented or non-vented hatch cover assemblies are typically attached to the top of the hopper railroad car to selectively close these inlets. Typically, each compartment includes at least one inlet closable by a vented hatch cover, and one or more inlets closable by a non-vented hatch cover.

Various different vented hatch cover assemblies that are attached to the tops of hopper railroad cars are well known. The typical known vented hatch cover assembly is configured to be in an open position to enable filling of a compartment through an inlet for that compartment, and in a closed and secured position to prevent materials from entering the compartment through that inlet while allowing air to enter the compartment through that inlet. Known vented hatch cover assemblies typically have vent openings or passageways that are protected from the elements. Various example known vented hatch cover assemblies are described in U.S. Pat. Nos. 4,819,830; 5,064,089; 5,622,117; 5,960,980; 6,296,135; 7,703,630; and 8,060,264.

One issue with various known vented hatch cover assemblies relates to potential loose material cross contamination issues. For example, when loading a hopper railroad car with a first type of loose material, the hatch covers (including any vented hatch covers) of the vented hatch cover assemblies are opened to enable filling the compartments with the first type of loose material through the inlets. During the filling process, some of the first type of loose material can get attached to or stuck in or to one or more parts of the hatch cover of the vented hatch cover assembly. Likewise, when the hatch cover is closed after filling, some of the first type of loose material in the compartment can get attached to or stuck in or to one or more parts of the hatch cover. After that hopper railroad car empties the load of the first type of loose material, the hopper railroad car may be subsequently used to transport a second different type of loose material. While the compartments and vented hatch cover assemblies of the hopper railroad car may be cleaned prior to filling the hopper railroad car with the second different type of loose material, some of the first type of loose material that is attached to or stuck in or to one or more parts of the vented hatch cover assemblies may not be removed. In such case, this first type of loose material attached to or stuck in the vented hatch cover assemblies may fall into the compartment and potentially contaminate the load of the second different type of loose material in the railroad hopper car.

Thus, there is a continuing need to provide vented hatch cover assemblies that minimize such cross contamination issues.

SUMMARY

Various embodiments of the present disclosure provide a railroad car hatch cover assembly including a replaceable combined vented hatch cover protector and gasket. In various embodiments of the present disclosure, the combined hatch cover protector and gasket: (1) can be quickly and easily mounted to a hatch cover of the vented hatch cover assembly; (2) can be quickly and easily removed therefrom for cleaning or replacement; (3) and minimizes cross contamination issues.

In various example embodiments, the railroad car vented hatch cover assembly of the present disclosure includes a hatch cover, a hatch cover securing assembly, and a combined hatch cover protector and gasket. In various embodiments, the combined hatch cover protector and gasket generally includes: (1) an outer sealing member configured to be positioned in a pocket of the hatch cover; (2) an inner protector element holder; (3) a protector element held by and secured to the protector element holder; and (4) a dual connector connecting the outer sealing member and the inner protector element holder, and configured to partially facilitate connection to the hatch cover. The dual connector connects the outer sealing member and the protector material holder at different distances, levels, or heights relative to the hatch cover. In various such embodiments, the outer sealing member, the inner protector element holder, and the dual connector are integrally formed as a single unit or monolithic unit in part to minimize the ability of loose materials to get attached to or stuck in or to the hatch cover.

In various other example embodiments, the railroad car combined hatch cover protector and gasket of the present disclosure includes: (1) an annular outer sealing member configured to be positioned in an annular pocket of a hatch cover, the outer sealing member including an annular bottom wall configured to engage a coaming upwardly extending from a roof of a hopper railroad car, a cylindrical outer wall connected to and extending upwardly from an outer end of the bottom wall, and a cylindrical inner wall connected to and extending upwardly from an inner end of the bottom wall; (2) an inner protector element holder including an annular outer support and a protector supporting crossbar;

(3) a protector element held by and secured to the protector element holder; and (4) a dual connector including a generally cylindrical upright wall having a top end integrally connected to the bottom wall of the outer sealing member and a bottom end integrally connected to an outer end of the outer support of the protector element holder. The dual connector defines spaced apart clip receiving slots configured to respectively receive clips inwardly extending from an inner rim of the hatch cover to facilitate connection to the hatch cover. The dual connector connects the outer sealing member and the protector material holder at different distances, levels, or heights relative to the hatch cover. In various such embodiments, the outer sealing member, the inner protector element holder, and the dual connector are integrally formed as a single unit or monolithic unit to minimize the ability of loose materials to get attached to or stuck in or to the hatch cover.

In various other example embodiments, the railroad car combined hatch cover protector and gasket of the present disclosure includes: (1) an annular outer sealing member configured to be positioned in an annular pocket of a hatch cover, the outer sealing member including an annular bottom wall configured to engage a coaming upwardly extending from a roof of a hopper railroad car, a cylindrical outer wall connected to and extending upwardly from an outer end of the bottom wall, and a cylindrical inner wall connected to and extending upwardly from an inner end of the bottom wall; (2) an inner protector element holder including an annular outer support and a protector supporting crossbar wherein the inner protector element is directly integrally connected to the bottom wall of the outer sealing member; and (3) a protector element held by and secured to the inner protector element holder. In various such embodiments, the outer sealing member and the inner protector element holder are integrally formed as a single unit or monolithic unit to minimize the ability of loose materials to get attached to or stuck in or to the hatch cover.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
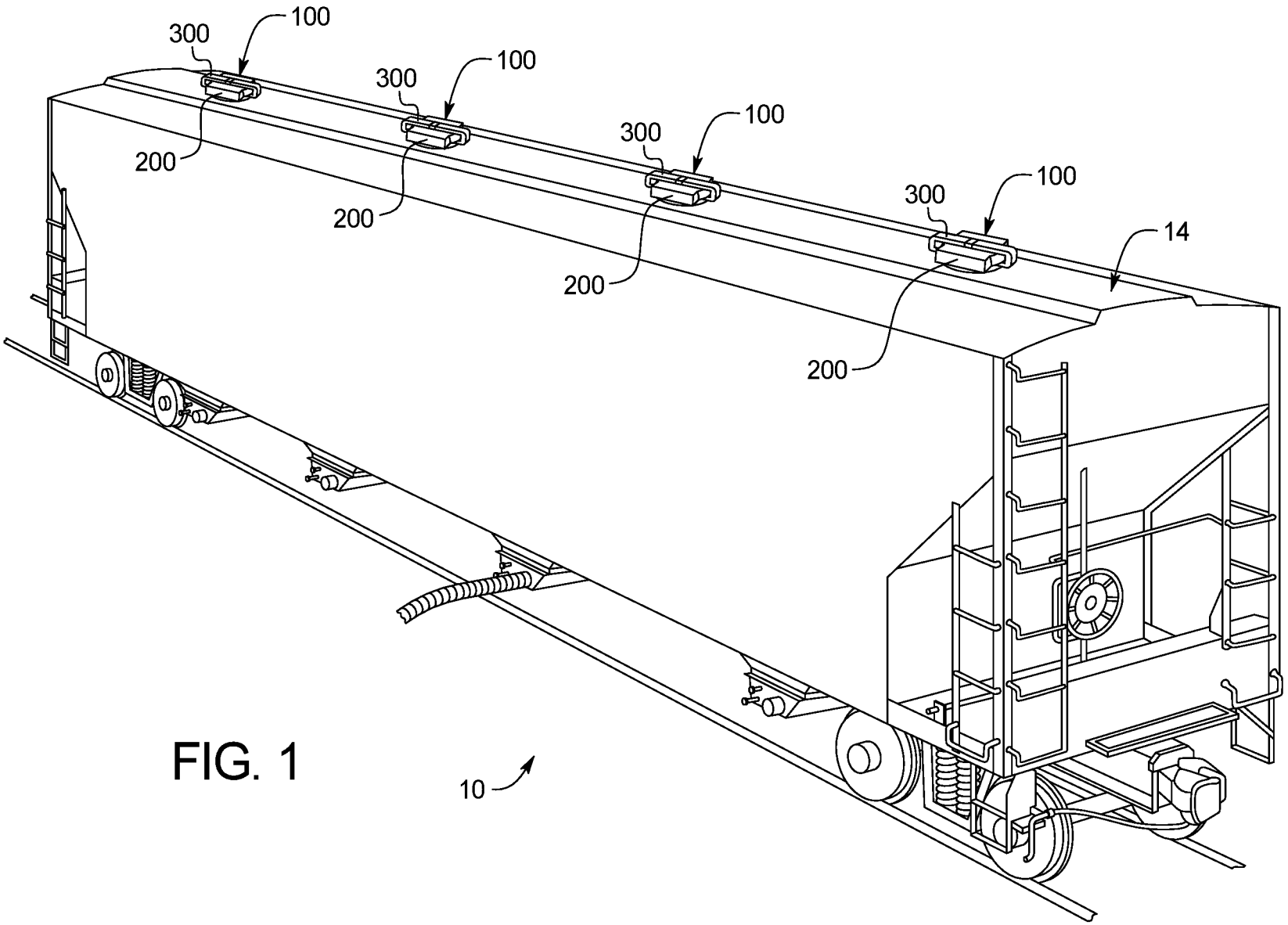
FIG. 1 is a side view of an example hopper railroad car positioned on railroad tracks.

While the features, devices, and apparatus described herein may be embodied in various forms, the drawings show and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, attached, connected, and the like, are not intended to be limited to direct mounting methods but should be interpreted broadly to include indirect and operably mounted, attached, connected and like mounting methods. This specification is intended to be taken as a whole and interpreted in accordance with the principles of the present disclosure and as understood by one of ordinary skill in the art.

Figure 9:
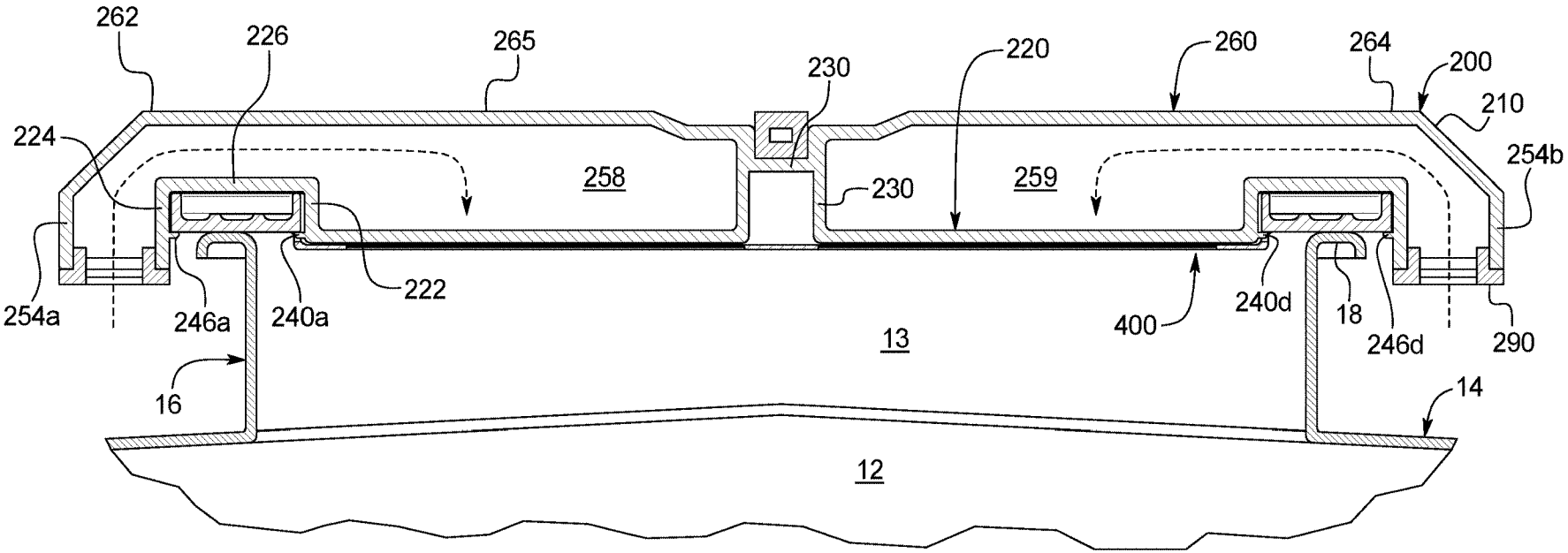
FIG. 9 is a cross-sectional view of the combined hatch cover protector and gasket and the hatch cover of the vented hatch cover assembly of FIG. 2, and partially taken substantially along line 9-9 of FIG. 8 with regard to the hatch cover, and positioned on a coaming extending upwardly from a roof of a hopper railroad car (shown in fragmentary).
Figure 10:
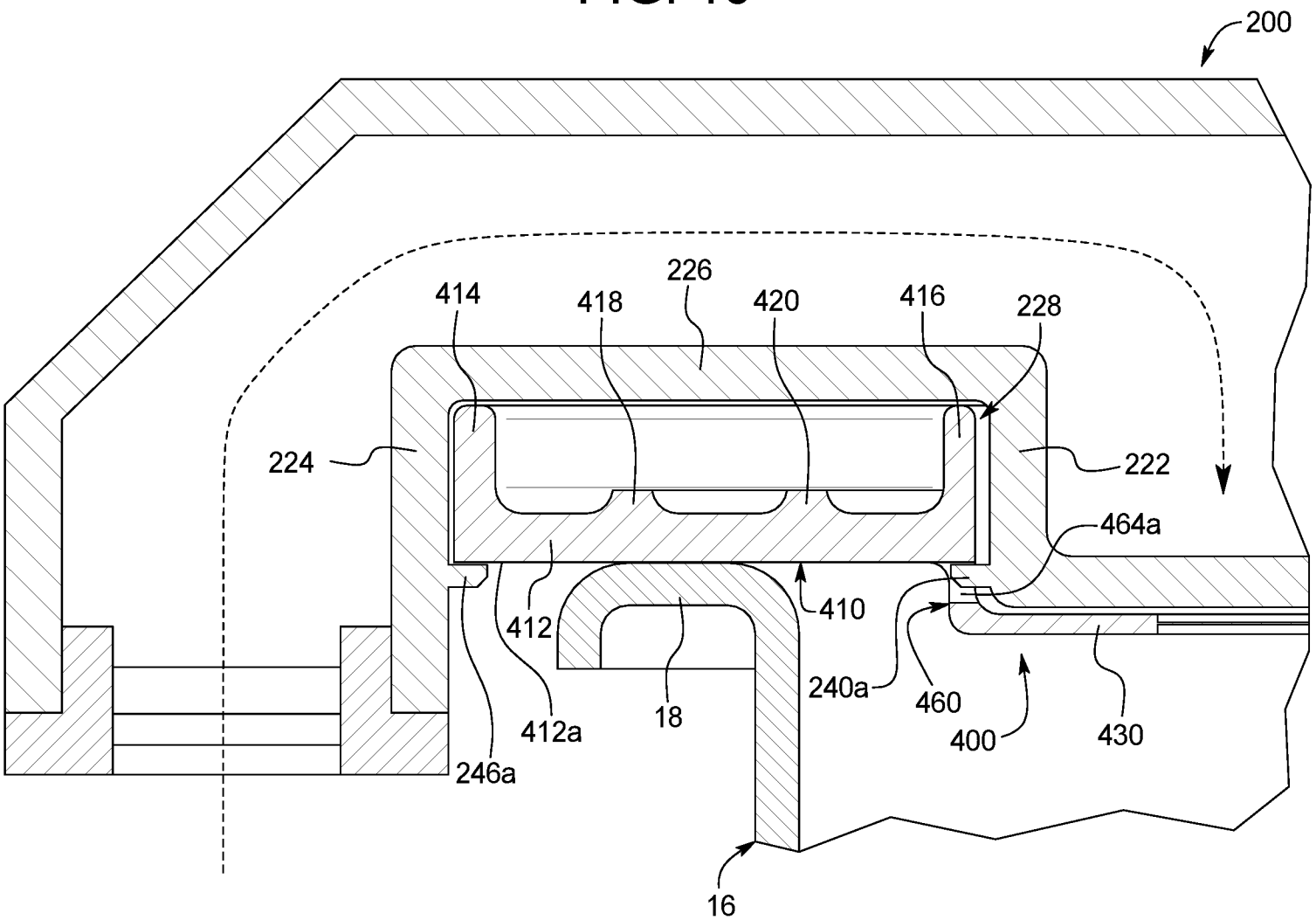
FIG. 10 is an enlarged fragmentary cross-sectional view of part of the combined hatch cover protector and gasket and part of the hatch cover of the vented hatch cover assembly of FIG. 2 positioned on part of a coaming extending upwardly from a roof of a hopper railroad car (shown in fragmentary).

Referring now to the drawings, FIGS. 1, 9, and 10 generally illustrate an example hopper railroad car 10 having a plurality of and specifically four railroad car vented hatch cover assemblies of the present disclosure, each indicated by numeral 100 and each attached to the roof 14 of the hopper railroad car 10. This example hopper railroad car 10 includes multiple compartments and particularly four compartments (not shown). This example hopper railroad car 10 is shown with just four inlets and four vented hatch cover assemblies for ease of illustration. It should be appreciated that in a typical known hopper railroad car with four compartments, the front and rear compartments each have two extra inlets, the center two compartment each have one extra inlet, and non-vented hatch covers are employed to close each of these additional inlets. The roof 14 of this example hopper railroad car 10 defines multiple top inlets or openings (not shown) for the respective compartments to facilitate filling of the compartments. The roof 14 includes multiple upwardly extending cylindrical coamings such as coaming 16. Each coaming such as coaming 16 surrounds a respective inlet or opening such as inlet or opening 12 and defines a generally cylindrical passageway such as passageway 13 extending upwardly from the inlet or opening 12. In this illustrated example, the top end of each coaming such as coaming 16 has a turned-over flange such as flange 18. It should be appreciated that not all coamings on hopper railroad cars include flanges or includes such flanges.

In various example embodiments of the present disclosure, each railroad car vented hatch cover assembly 100 generally includes: (a) a hatch cover 200; (b) a hatch cover securing assembly 300; and (c) a removable combined hatch cover protector and gasket 400 (not shown in FIG. 1). The combined hatch cover protector and gasket 400 is configured to be quickly and easily removably attached to the hatch cover 200 as further described below. The hatch cover 200 is configured to be attached to the hatch cover securing assembly 300 in a conventional manner. The hatch cover securing assembly 300 is configured to be attached to a roof (such as roof 14) of a railroad hopper car (such as railroad hopper car 10) in a conventional manner and to move the hatch cover 200 and the attached combined hatch cover protector and gasket 400 from: (a) a fully open and unsecured position (not shown) to enable filling of a compartment through a coaming to which the vented hatch cover assembly 100 is associated with, to (b) a closed and secured position on that coaming as generally shown in FIGS. 1, 9, and 10. The hatch cover securing assembly 300 is thus configured to secure the hatch cover 200 and the attached combined hatch cover protector and gasket 400 to the respective coaming 16 and to the roof 14 of the hopper railroad car 10. When the combined hatch cover protector and gasket 400 is secured to the hatch cover 200, the combined hatch cover protector and gasket 400 prevent materials that are being loaded into the hopper railroad car 10 or that are in the hopper railroad car 10 from becoming stuck or lodged in the hatch cover, and thus minimizes potential subsequent contamination of loads carried by the hopper railroad car 10. Additionally, when the hatch cover 200 and the combined hatch cover protector and gasket 400 are secured to the coaming 16, air in the atmosphere can enter the respective compartment in the hopper railroad car 10 through air intake passages in the hatch cover 200 and through the combined hatch cover protector and gasket 400 as indicated by the dotted lines and arrows in FIGS. 9 and 10.

Example versions of the hatch cover 200 and the hatch cover securing assembly 300 of the present disclosure are generally described in U.S. Pat. Nos. 4,819,830; 5,064,089; 5,622,117; 5,960,980; 6,296,135; 7,703,630; and 8,060,264, which are incorporated herein by reference. The hatch cover securing assembly 300 will thus not be described herein in any detail. The hatch cover 200 will also thus only be briefly described herein for purposes of understanding the vented hatch cover assembly 100 and the combined hatch cover protector and gasket 400 of the present disclosure.

Referring now to FIGS. 2, 8, 9, and 10, the hatch cover 200 generally includes: (1) a body 210 including a base 220 and a shell 260 that includes hoods 262 and 264 that respectively define air passages 258 and 259 (as best shown in FIGS. 9 and 10). The base 220 has a generally circular shape and includes an inner portion defining a partially cylindrical inner rim 222. The base 220 includes a central rib 230 and two generally Y-shaped ribs 232 and 234 extending upwardly from the bottom of the base 220. The base 220 further includes an outer portion defining a generally cylindrical outer rim 224 located radially outward of and spaced apart from the inner rim 222.

In this illustrated example embodiment, the base 220 includes six equally or approximately equally spaced apart inner clips 240*a*, 240*b*, 240*c*, 240*d*, 240*e*, and 240*f* that each extend radially outwardly from the inner rim 222. In certain example embodiments, each inner clip 240*a*, 240*b*, 240*c*, 240*d*, 240*e*, and 240*f* has a ramped surface (not shown) facing downward and radially outward. In certain example embodiments, each inner clip 240*a*, 240*b*, 240*c*, 240*d*, 240*e*, and 240*f* also has a ledge (not shown) facing upwardly. In certain example embodiments, the inner clips 240*a*, 240*b*, 240*c*, 240*d*, 240*e*, and 240*f* all have approximately the same height and approximately the same width. It should be appreciated that quantity of the inner clips can vary and that the shape, size, and spacing of the inner clips may vary in accordance with the present disclosure.

In this illustrated example embodiment, the base 220 includes six equally or approximately equally spaced apart outer clips 246*a*, 246*b*, 246*c*, 246*d*, 246*e*, and 246*f* that each extend radially inwardly from the outer rim 224. In certain example embodiments, each outer clip 246*a*, 246*b*, 246*c*, 246*d*, 246*e*, and 246*f* has a ramped surface (not shown) facing downward and radially inward. In certain example embodiments, each outer clip 246*a*, 246*b*, 246*c*, 246*d*, 246*e*, and 246*f* also has a ledge (not shown) facing upwardly. In certain example embodiments, the outer clips 246*a*, 246*b*, 246*c*, 246*d*, 246*e*, and 246*f* all have approximately the same height and approximately the same width. It should be appreciated that quantity of the outer clips can vary and that the shape, size, and spacing of the outer clips may vary in accordance with the present disclosure.

Figure 2:
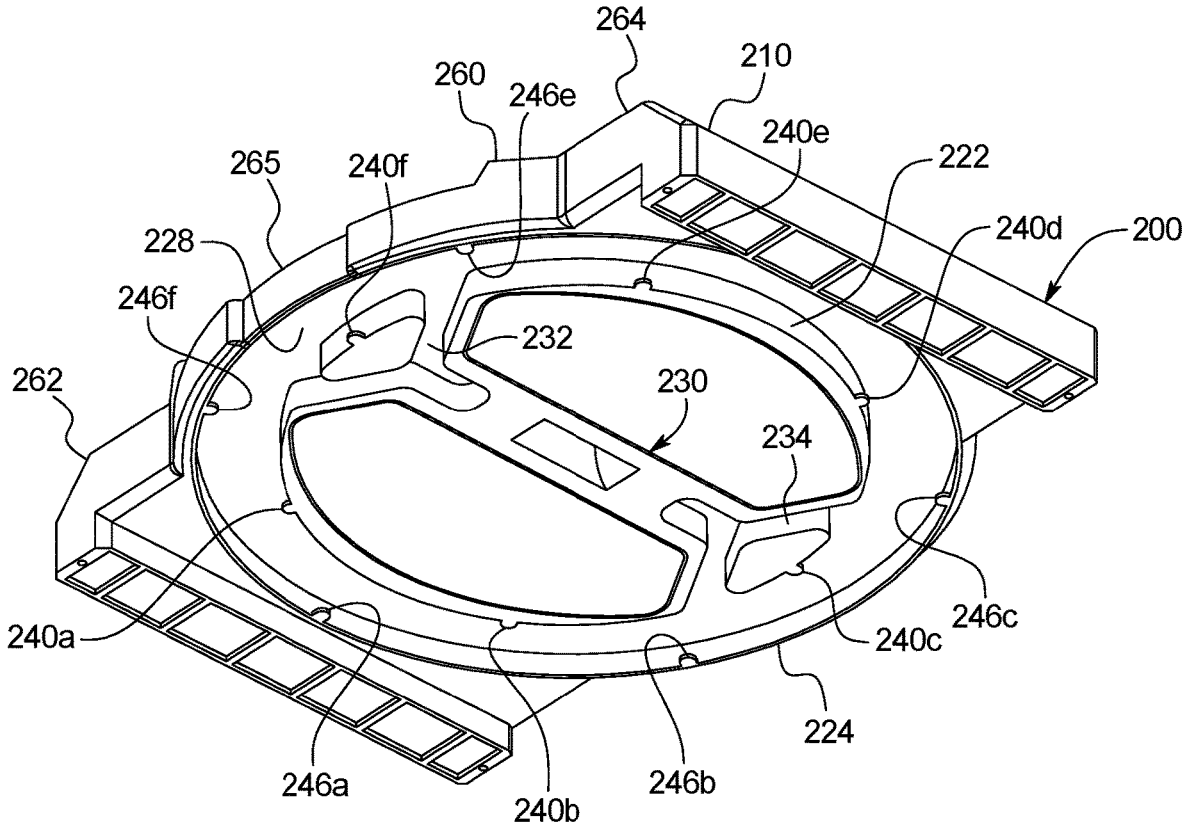
FIG. 2 is an exploded bottom perspective view of a combined hatch cover protector and gasket, and a hatch cover of a vented hatch cover assembly of one example embodiment of the present disclosure.
Figure 2:
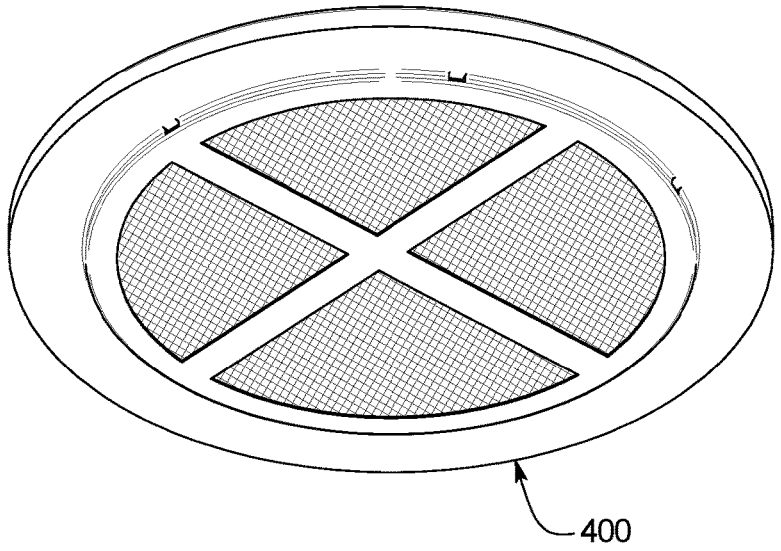
Figure 3:
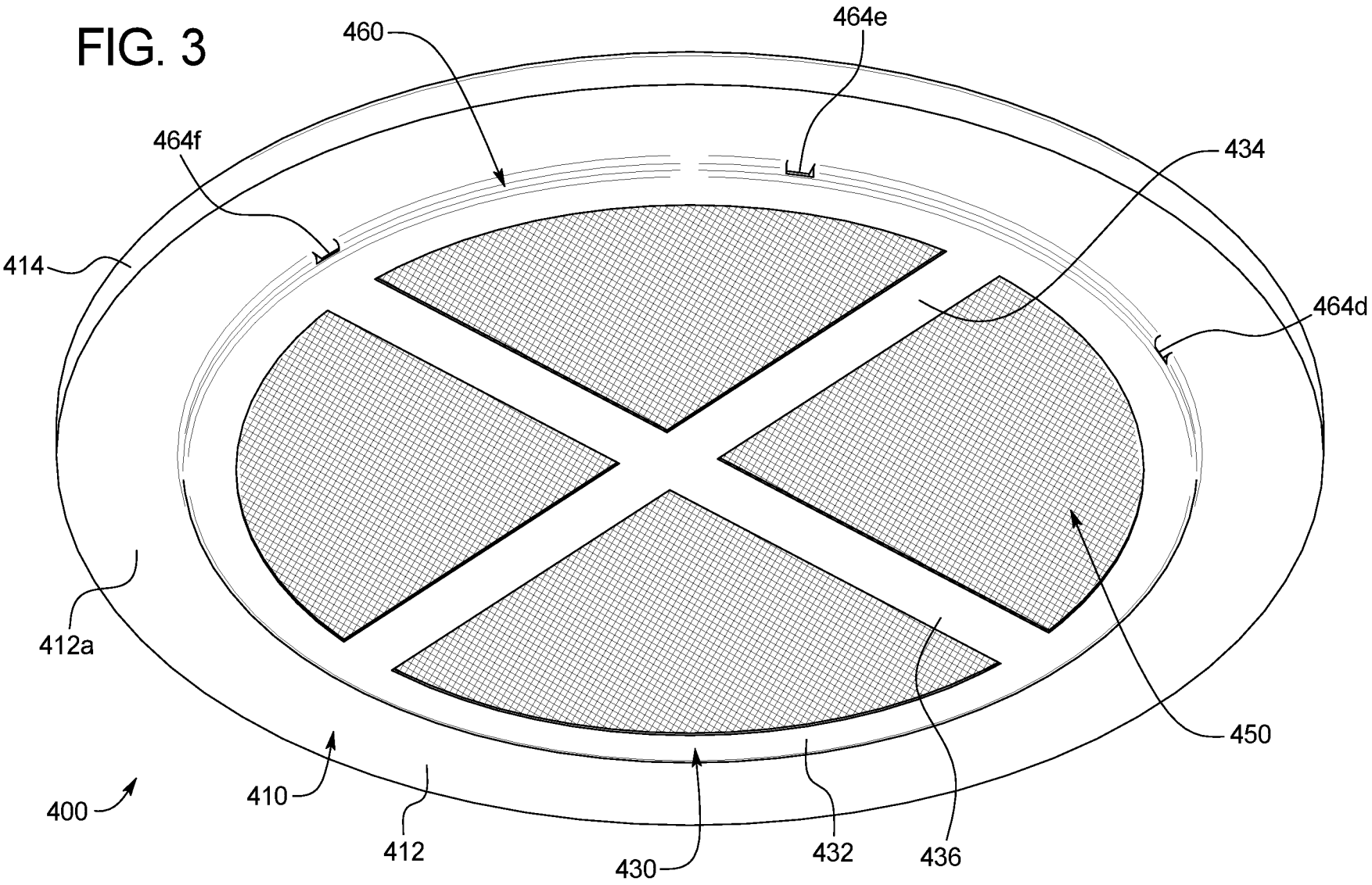
FIG. 3 is an enlarged bottom perspective view of the combined hatch cover protector and gasket of the vented hatch cover assembly of FIG. 2.
Figure 4:
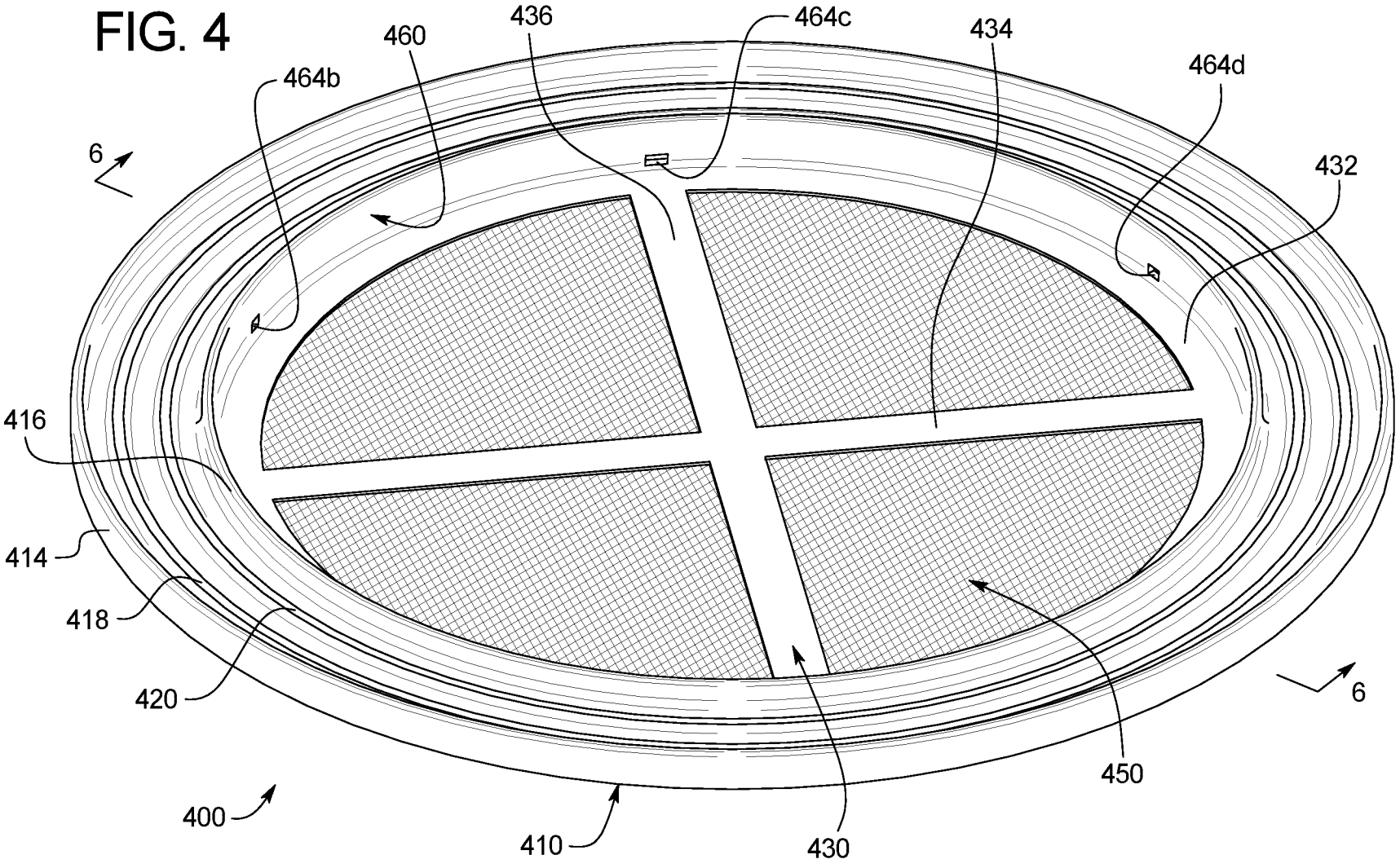
FIG. 4 is an enlarged top perspective view of the combined hatch cover protector and gasket of the vented hatch cover assembly of FIG. 2.
Figure 5:
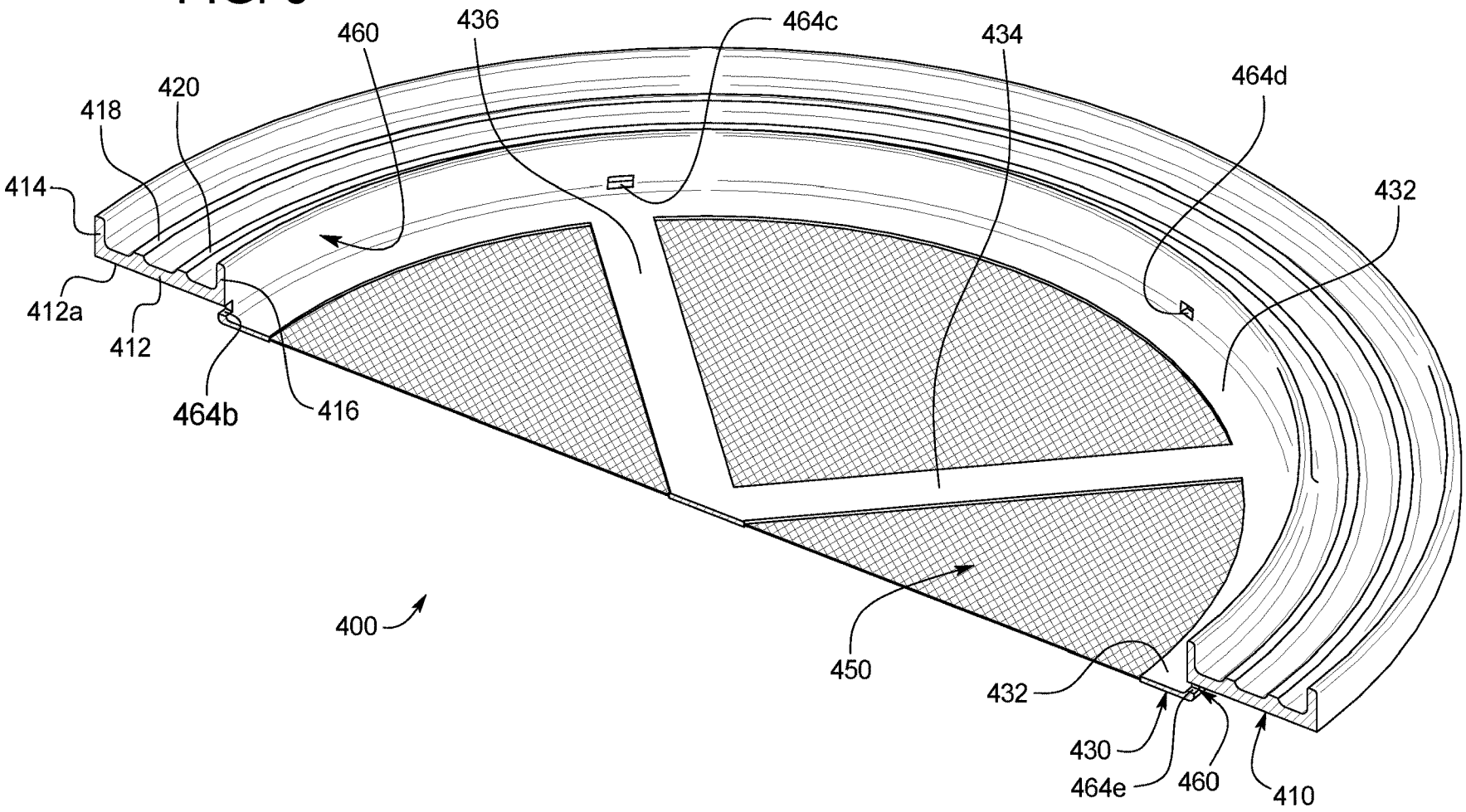
FIG. 5 is an enlarged fragmentary top perspective view of the combined hatch cover protector and gasket of the vented hatch cover assembly of FIG. 2.
Figure 6:
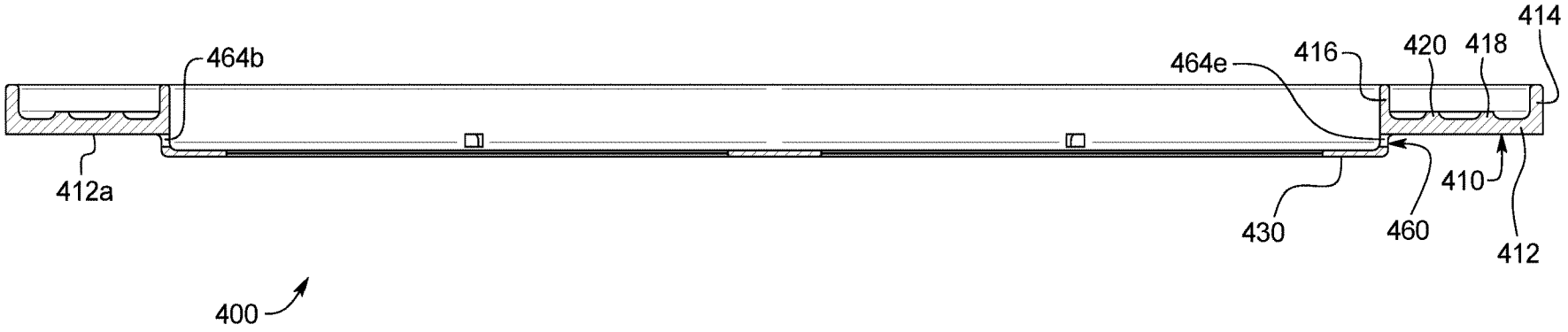
FIG. 6 is an enlarged cross-sectional view of the combined hatch cover protector and gasket of the vented hatch cover assembly of FIG. 2, taken substantially along line 6-6 of FIG. 4.
Figure 7:
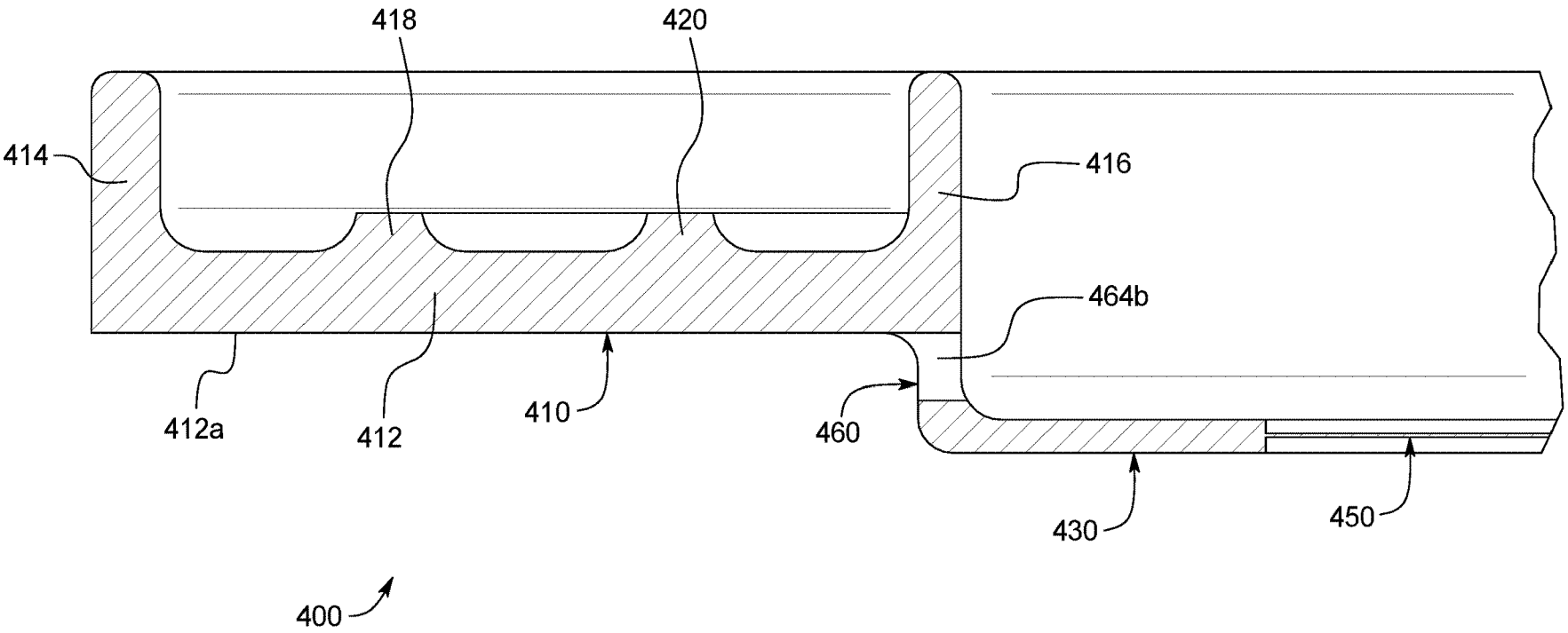
FIG. 7 is an enlarged fragmentary perspective view of part of the combined hatch cover protector and gasket of the vented hatch cover assembly of FIG. 2.
Figure 8:
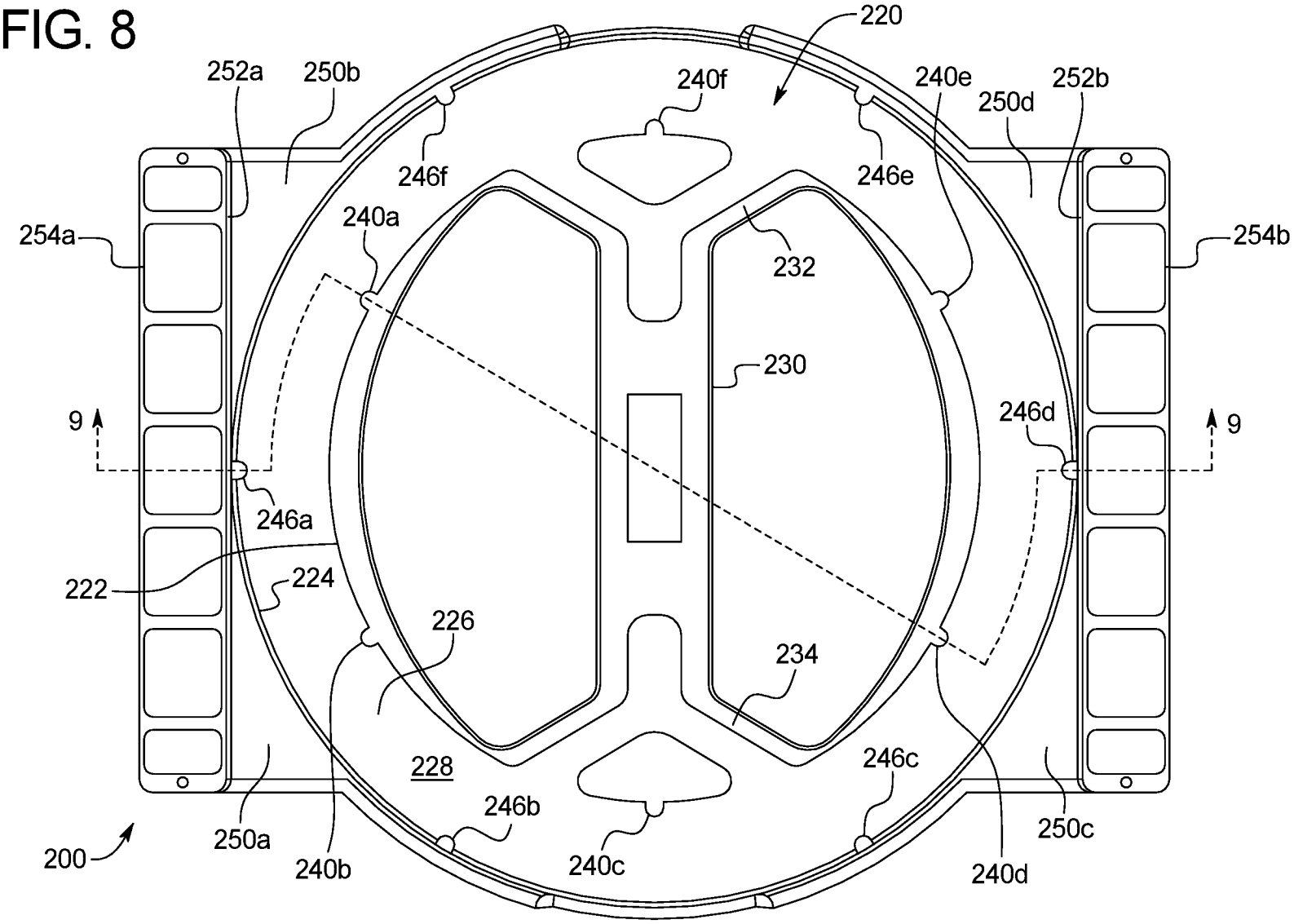
FIG. 8 is an enlarged bottom view of the hatch cover of the vented hatch cover assembly of FIG. 2.

In this illustrated example embodiment, the inner clips 240*a*, 240*b*, 240*c*, 240*d*, 240*e*, and 240*f* and the outer clips 246*a*, 246*b*, 246*c*, 246*d*, 246*e*, and 246*f* are staggered as best shown in FIGS. 2 and 8, although aligned clips could also be used for the hatch cover in alternative embodiments of the present disclosure.

The base 220 includes a ring-shaped or annular seat 226 connecting the upper end of the outer rim 224 to the upper end of the inner rim 222. The seat 226 is configured to overlie the top of the flange 18 of the coaming 16 when the vented hatch cover assembly 100 is positioned on the coaming 16 in the closed position as shown in FIGS. 1, 9, and 10. The inner rim 222, the seat 226, and the outer rim 224 define an annular pocket 228 configured to receive the outer sealing member 410 of the combined hatch cover protector and gasket 400 as described below and as shown in FIGS. 9 and 10.

The base 220 also includes four approximately circumferentially spaced bottom walls 250*a*, 250*b*, 250*c*, and 250*d* extending radially outward from the outer rim 224 and that respectively terminate at hood inner wall 252*a* and 252*b*. The hood inner walls 252*a* and 252*b* extend downward from the respective bottom walls 250*a* and 250*b*, and 252*c*, and 252*d*. The shell 260 and particularly the hoods 262 and 264 respectively include hood outer walls 254*a* and 254*b*.

This configuration of the base 220 and the shell 260 (including hoods 262 and 264) as further described in the patents mentioned above define air passages 258 and 259 (as best shown in FIGS. 9 and 10). This configuration provides efficient air flow paths. Although not shown, additional air protectors can be attached to the outer air inlets as further described in the above mentioned patents.

In various embodiments, the hatch cover is made from a high density polyethylene (commonly called HDPE). In various embodiments, the hatch cover includes a UV inhibitor. In various embodiments, the hatch cover includes HDPE with a UV inhibitor. The hatch cover can be made using any suitable material(s).

As best shown in FIGS. 3, 4, 5, 6, 7, 9, and 10, the example combined hatch cover protector and gasket 400 generally includes: (1) an outer sealing member 410 configured to be position in the pocket 228 and configured to partially function as a gasket that provides a tight seal with the top of the coaming 16; (2) an inner protector element holder 430; (3) an air permeable protector element 450 held by and secured to the protector element holder 430; and (4) a dual connector 460 connecting the outer sealing member 410 and the inner protector element holder 430, and configured to partially connect the combined hatch cover protector and gasket 400 to the hatch cover 200. The dual connector connects the outer sealing member and the protector material holder at different distances, levels, or heights relative to the hatch cover as further discussed below.

In this illustrated example embodiment, the outer sealing member 410, the inner protector element holder 430, and the dual connector 460 are made from a thermoplastic elastomer or other suitable material. In various embodiments of the present disclosure, the outer sealing member 410, the inner protector element holder 430, and the dual connector 460 are integrally formed as a single unit or monolithic unit in part to minimize the ability of loose materials to get attached to or stuck in or to the hatch cover. In various such embodiments, the outer sealing member 410, the inner protector element holder 430, and the dual connector 460 are formed without any seam or joints. In various embodiments, the protector element 450 is connected to the inner protector element holder 430 without forming any gaps or pockets that can hold loose materials. Thus, the outer sealing member 410, the inner protector element holder 430, the protector element 450, and the dual connector 460 are formed to minimize contamination issues. The combined hatch cover protector and gasket 400 is also formed as a one piece unit to facilitate quick and easy installation.

More specifically, the outer sealing member 410 includes a generally disk-shaped or annular bottom wall 412 having a bottom sealing surface 412*a* and a top surface (not labeled). The outer sealing member 410 further includes: (1) a cylindrical outer wall 414 connected to and extending upwardly from an outer end (not labeled) of the bottom wall 412; and (2) a cylindrical inner wall 416 connected to and extending upwardly from an inner end (not labeled) of the bottom wall 412. The outer sealing member 410 also includes two spaced apart cylindrical lips or flanges 418 and 420 connected to and extending upwardly from the top surface of the bottom wall 412. The cylindrical lips or flanges 418 and 420 provide a desired amount of additional rigidity for the bottom wall 412, the sealing surface 412*a*, and the entire outer sealing member 410. It should be appreciated that other suitable rigidity adding members can be employed in accordance with the present disclosure. The outer wall 414 and the inner wall 416 each include rounded top edges (not labeled) that are configured to engage the bottom surface of the disk-shaped or annular seat 226. The bottom surface 412*a* is generally flat and configured to engage a coaming 16 such as the flange 18 of the coaming 16 as shown in FIGS. 9 and 10 when the hatch cover assembly 100 is in the closed position to provide a weather tight engagement with the coaming 16. In instances where no flange 18 is present, the bottom surface 412*a* of the bottom wall 412 of the outer sealing member 410 is configured to contact the top of the ring shaped coaming 16. The bottom surface 412*a* of the wall 412 of the outer sealing member 410 is also configured to be engaged by the inwardly extending clips 246*a*, 246*b*, 246*c*, 246*d*, 246*e*, and 246*f* to removably hold the outer sealing member 410 in the pocket 228 as further described below.

The protector element holder 430 includes a generally disk-shaped or annular outer support 432 and two protector supporting crossbars 434 and 436. Crossbar 434 extends from a first area of the inner edge (not labeled) of the outer support 432 to a second area of the inner edge (not labeled) of the outer support 432 (that is across from or opposite the first area). Crossbar 434 is connected to the outer support 432 at both of the first and second areas. Likewise, crossbar 436 extends from a third area of the inner edge (not labeled) of the outer support 432 to a fourth area of the inner edge (not labeled) of the outer support 432 (that is across from or opposite the third area). Crossbar 436 is connected to the outer support 432 at both of the third and fourth areas. Crossbar 434 and crossbar 436 are connected to each other at a central area (not labeled). The protector element holder 430, and particularly the outer support 432 and the crossbars 434 and 436 define a frame that has four generally pie shaped protector openings (not labeled). It should be appreciated that the protector element holder can be otherwise suitably configured in accordance with the present disclosure.

The air permeable protector material of the protector element 450 is suitably attached to the protector element holder 430, and particularly the outer support 432 and the crossbars 434 and 436 inner protector element holder 430. The attachment may be accomplished in any suitable manner such as but not limited to by over-molding the protector material with the outer support 432 and the crossbars 434 and 436. The protector material may be any suitable material, such as but not limited to a polyester or a woven nylon.

The protector material enables air to flow through the combined hatch cover protector and gasket 400 into the respective compartment of the hopper railroad car 10 while preventing loose materials from getting attached to or stuck in or to various parts of the hatch cover 200 (i.e., the protector material and the entire combined hatch cover protector and gasket 400 protect various parts of the hatch cover from the loose materials).

The dual connector 460 includes a generally cylindrical upright wall having an inner surface (not labeled), an outer surface (not labeled), a top end (not labeled), and a bottom end (not labeled). The bottom end is integrally (such as monolithically) connected to the outer end of the outer support 432 of the protector element holder 430. The top end is integrally connected to the bottom surface 412*a* of the bottom wall 412 of the outer sealing member 410. The dual connector 460 generally serves two purposes. The dual connector 460 integrally (such as monolithically) connects the outer sealing member 410 and the protector material holder 430 at different distances, heights, or levels relative to each other and relative to the hatch cover 200 as best shown in FIGS. 5, 6, 7, 9, and 10. In other words, in this illustrated example: (1) the wall 412 is closer to the seat 226 than the protector element holder 430; (2) the top surface of the wall 412 is closer to the seat 226 than the top surface of the protector element holder 430; (3) the bottom surface 412*a* of the wall 412 is closer to the seat 226 than the top surface of the protector element holder 430; and (4) the bottom surface 412*a* of the wall 412 is closer to the seat 226 than the bottom surface of the protector element holder 430. The dual connector 460 facilitates attachment of the combined hatch cover protector and gasket 400 to the hatch cover 200 as further described below. The dual connector 460 defines six spaced apart clip receiving slots 464*a*, 464*b*, 464*c*, 464*d*, 464*e*, and 464*f*. The clip receiving slots 464*a*, 464*b*, 464*c*, 464*d*, 464*e*, and 464*f* are configured to respectively receive the outwardly extending clips 240*a*, 240*b*, 240*c*, 240*d*, 240*e*, and 240 to removably hold the outer sealing member 410 in the pocket 228. It should be appreciated that the quantity, shape, size and spacing of the clip receiving slots may vary in accordance with the present disclosure It should be appreciated from the above that the combined hatch cover protector and gasket 400 is quickly and easily removably securely attachable to the base 220 of the hatch cover 200. More specifically, to attach the combined hatch cover protector and gasket 400 to the hatch cover 200, the combined hatch cover protector and gasket 400 is first aligned with the hatch cover 200 such that each of the clip receiving slots 464*a*, 464*b*, 464*c*, 464*d*, 464*e*, and 464*f* is aligned with a respective one of the outwardly extending clips 240*a*, 240*b*, 240*c*, 240*d*, 240*e*, and 240*f*. The combined hatch cover protector and gasket 400 is then moved toward and adjacent to the bottom surface of the protector element holder 430 such that each clip extends into the respective clip receiving slot (i.e., clip 240*a* extends into clip receiving slot 464*a* as shown in FIGS. 9 and 10, clip 240*b* extends into clip receiving slot 464*b*, clip 240*c* extends into clip receiving slot 464*c*, clip 240*d* extends into clip receiving slot 464*d* as shown in FIG. 9, clip 240*e* extends into clip receiving slot 464*e*, and clip 240*f* extends into clip receiving slot 464*f*). This can be done simultaneously or sequentially. It should be appreciated that the outer sealing member 410 and specifically at least the wall 416 are flexible enough to bend outwardly to facilitate this insertion of the outwardly extending clips 240*a*, 240*b*, 240*c*, 240*d*, 240*e*, and 240*f* into the respective clip receiving slots 464*a*, 464*b*, 464*c*, 464*d*, 464*e*, and 464*f*. With all six inner clips situated in the clip receiving slots, the combined hatch cover protector and gasket 400 is partially secured to the hatch cover 200. It should be appreciated that the clearances between the walls that define the respective clip receiving slots 464*a*, 464*b*, 464*c*, 464*d*, 464*e*, and 464*f* and the outwardly extending clips 240*a*, 240*b*, 240*c*, 240*d*, 240*e*, and 240*f* are relatively small to prevent loose materials from getting stuck in such slots, thus minimizing the potential cross contamination issues. In certain embodiments, one or more dimensions of the respective clip receiving slots 464*a*, 464*b*, 464*c*, 464*d*, 464*e*, and 464*f* are the same size or slightly smaller than the corresponding dimension of the respective outwardly extending clips 240*a*, 240*b*, 240*c*, 240*d*, 240*e*, and 240*f* to prevent loose materials from getting stuck in such slots, thus minimizing the potential cross contamination issues.

To further attach the combined hatch cover protector and gasket 400 to the hatch cover 200, the wall 414 of the outer sealing member 410 is flexed inwardly such that the bottom surface 412*a* of the bottom wall 412 moves (or can be moved or pushed and is moved or pushed) above each of the inwardly extending outer clips 246*a*, 246*b*, 246*c*, 246*d*, 246*e*, and 246*f*. This can be done simultaneously or sequentially. After doing so, the inwardly extending outer clips 246*a*, 246*b*, 246*c*, 246*d*, 246*e*, and 246*f* each engage the bottom surface 412*a* of the wall 412 of the outer sealing member 410 to maintain the outer sealing 410 in the pocket 228 as partially shown in FIGS. 9 and 10. The attachment of the combined hatch cover protector and gasket 400 in this manner thus positions outer sealing member 410 of the combined hatch cover protector and gasket 400 in the pocket 228.

Whenever necessary, the combined hatch cover protector and gasket 400 can be removed from the hatch cover 200 for cleaning and/or replacement by reversing this installation process.

It should be appreciated that, when attached to the base 220 of the hatch cover 200, the combined hatch cover protector and gasket 400 and particularly part of the inner protector element holder 430 and the protector element 450 are disposed under the air passages 258 and 259 such that the protector element 450 is in the flow path of the air exiting the air passages 258 and 259 and flowing into the compartment. The inner protector element 450 allows air to flow through it into the compartment. The inner protector element 450 also functions in part to prevent or reduce contaminants from entering the interior compartment of the hopper railroad car through these passageways. The inner protector element 450 also minimizes the ability of loose materials from getting attached to or stuck in or to the hatch cover 200 and thus minimizes the above described potential contamination issues.

It should be appreciated that the vented hatch cover assembly 100 can include side intake filters (not shown) that are removably secured to the hatch cover 200. These side intake filters prevent or reduce outside contaminates from entering the hatch cover 200 and thus the compartment. Each such intake filter would be disposed over the respective air intake passage of one of the hoods 262 and 264, such that the side intake protector is in the flow path of the air entering the air intake passages 258 and 259. Examples of these side air filters can be configured as described in U.S. Pat. No. 7,703,630, or otherwise suitably formed.

Referring now to FIGS. 11 to 20, another example embodiment of the present disclosure is illustrated. In this example embodiment, the railroad car vented hatch cover assembly 1100 generally includes: (a) a hatch cover 1200;

(b) a suitable hatch cover securing assembly 1300; and (c) a removable combined hatch cover protector and gasket 1400.

Figure 11:
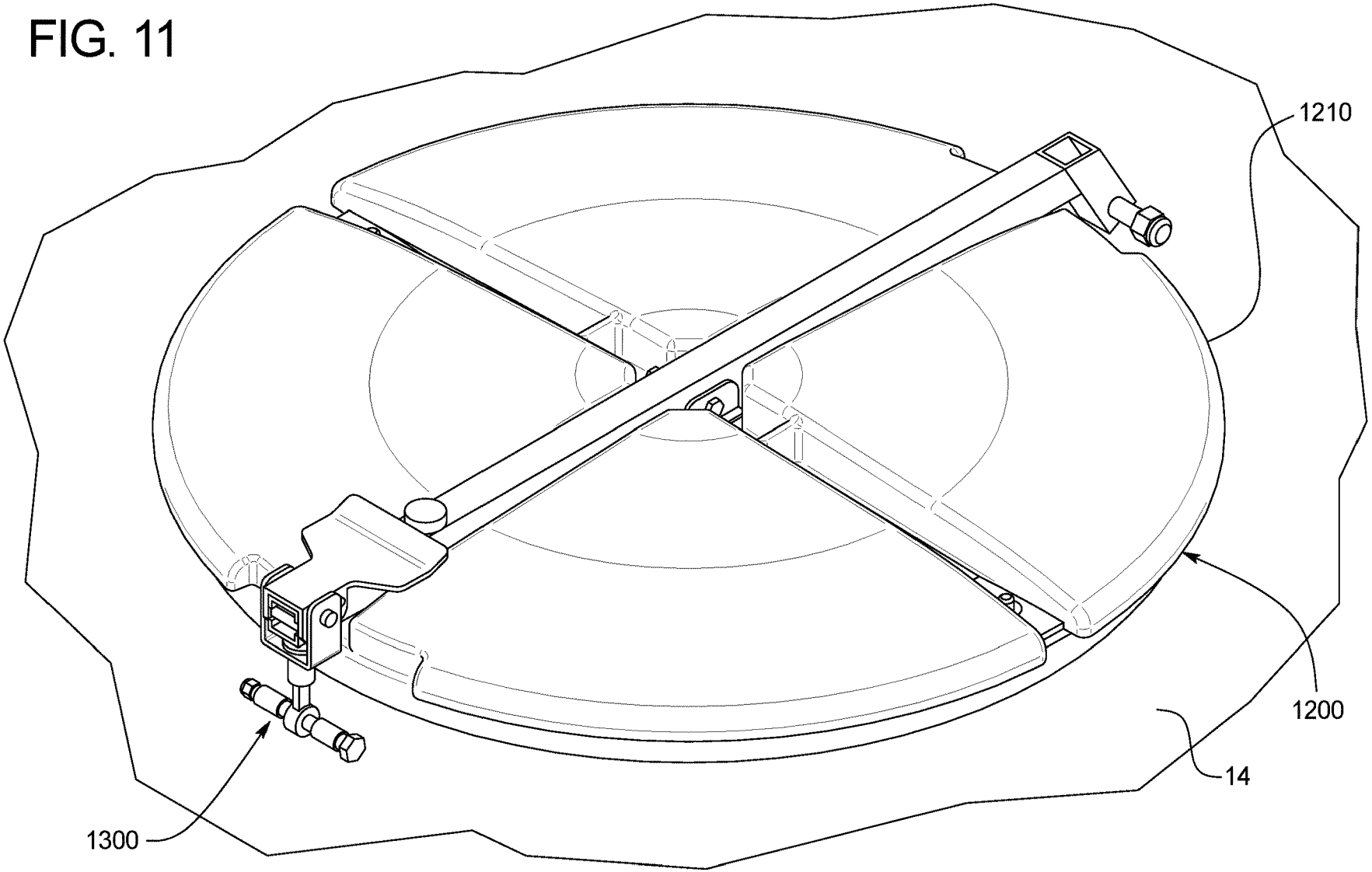
FIG. 11 is top perspective view of a vented hatch cover assembly of another example embodiment of the present disclosure, shown attached to a hopper railroad car roof (shown in fragmentary).
Figure 12:
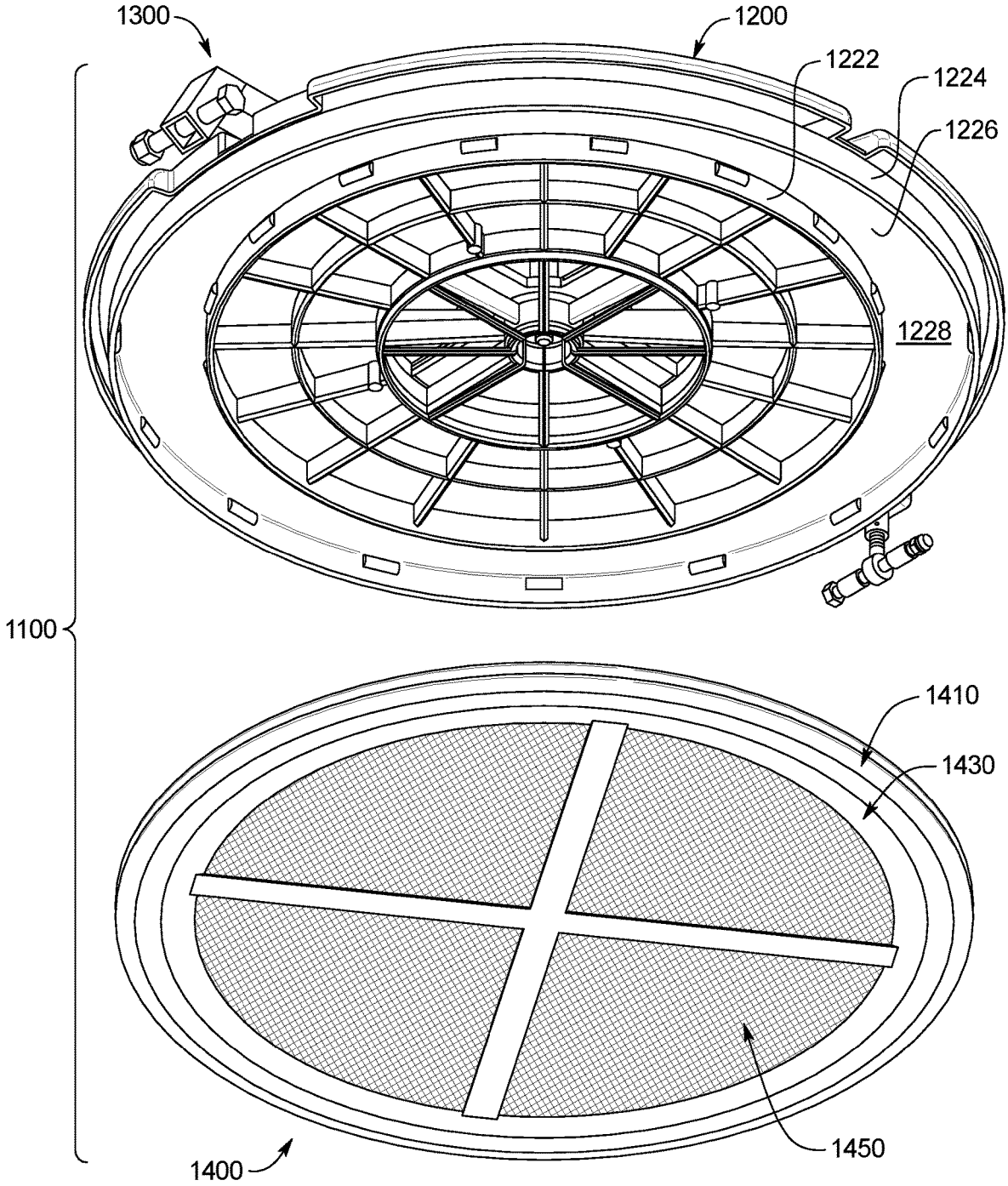
FIG. 12 is an exploded bottom perspective view of a combined hatch cover protector and gasket, a hatch cover, and a hatch cover securing assembly of the vented hatch cover assembly of FIG. 11.
Figure 13:
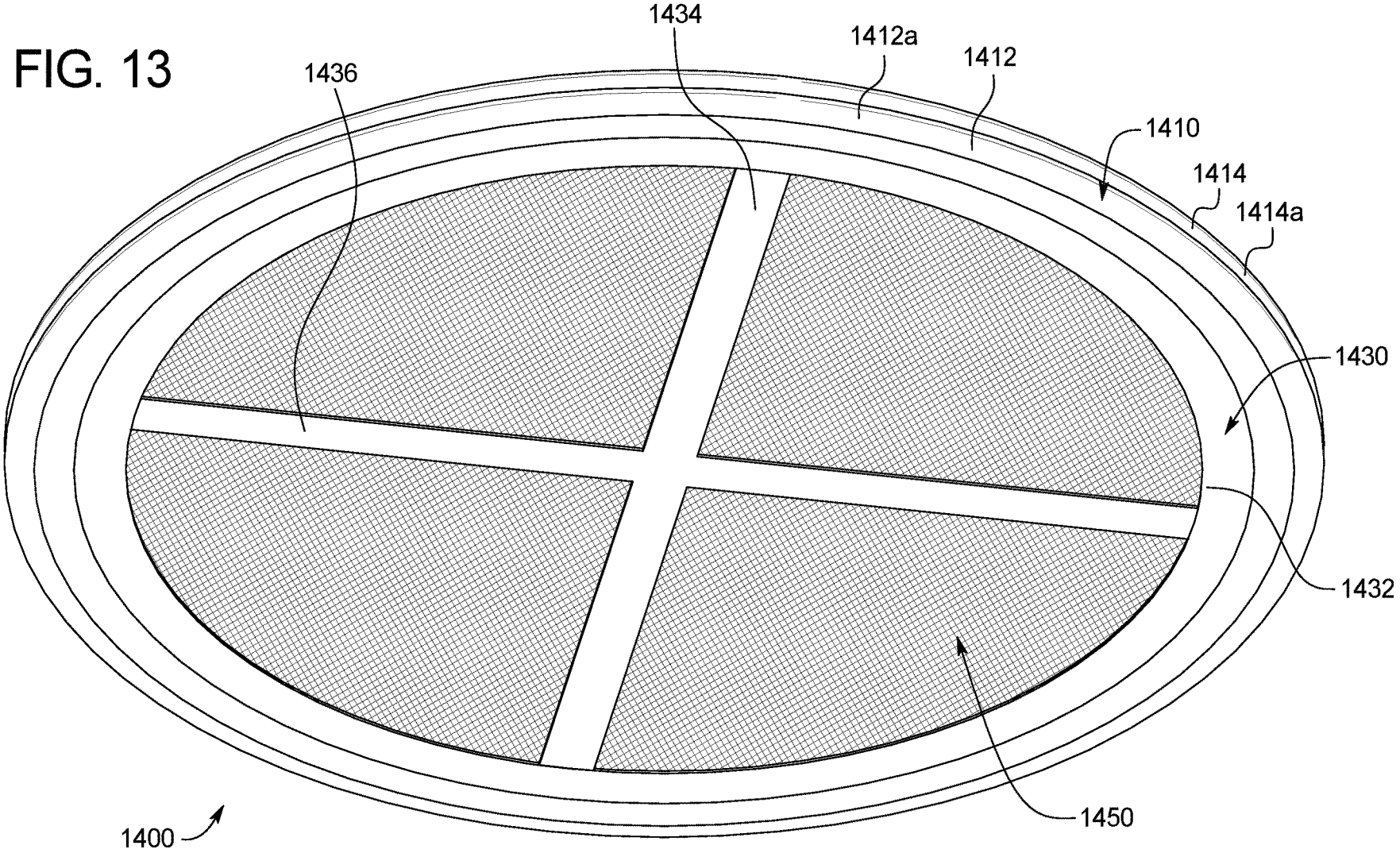
FIG. 13 is an enlarged bottom perspective view of the combined hatch cover protector and gasket of the vented hatch cover assembly of FIG. 11.
Figure 14:
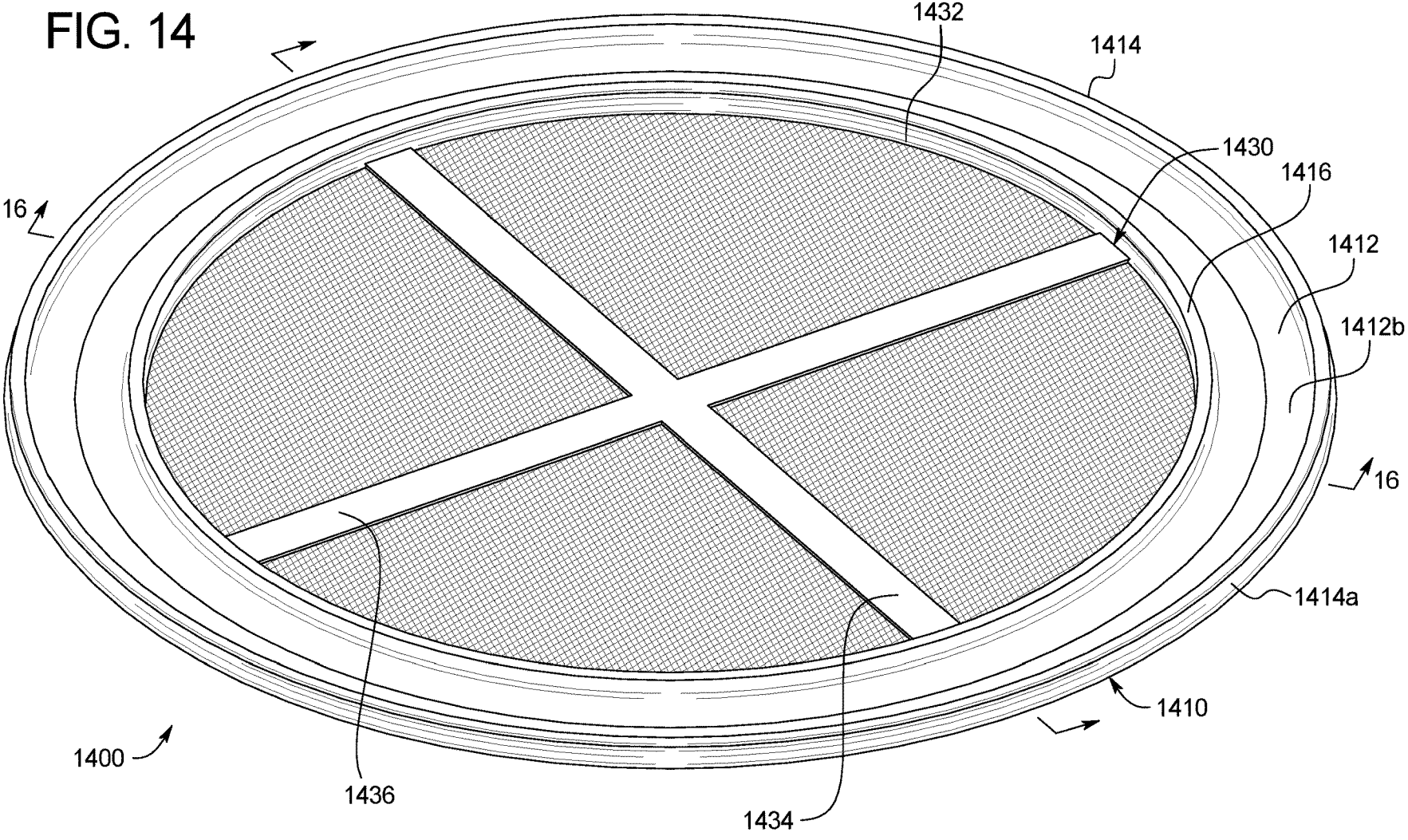
FIG. 14 is an enlarged top perspective view of the combined hatch cover protector and gasket of the vented hatch cover assembly of FIG. 11.
Figure 15:
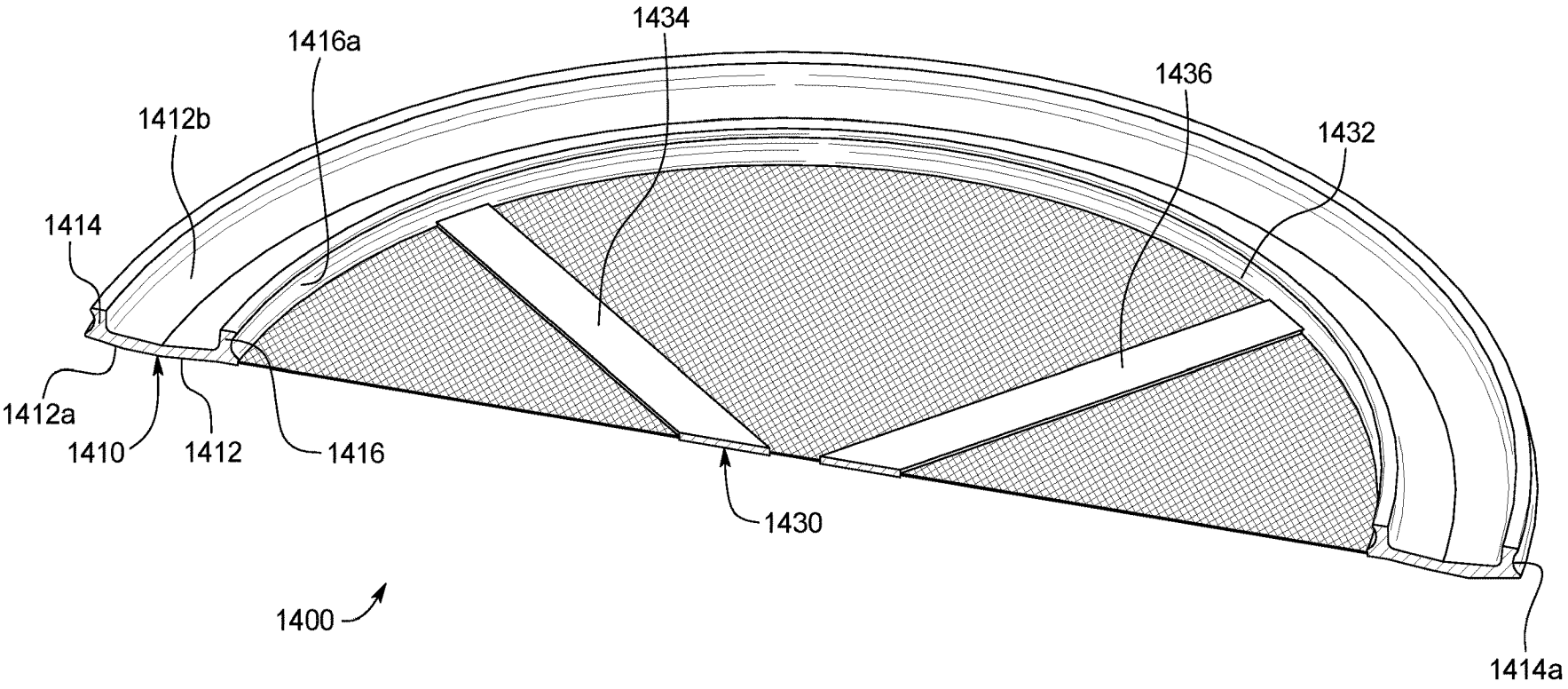
FIG. 15 is an enlarged fragmentary top perspective view of the combined hatch cover protector and gasket of the vented hatch cover assembly of FIG. 11.
Figure 16:
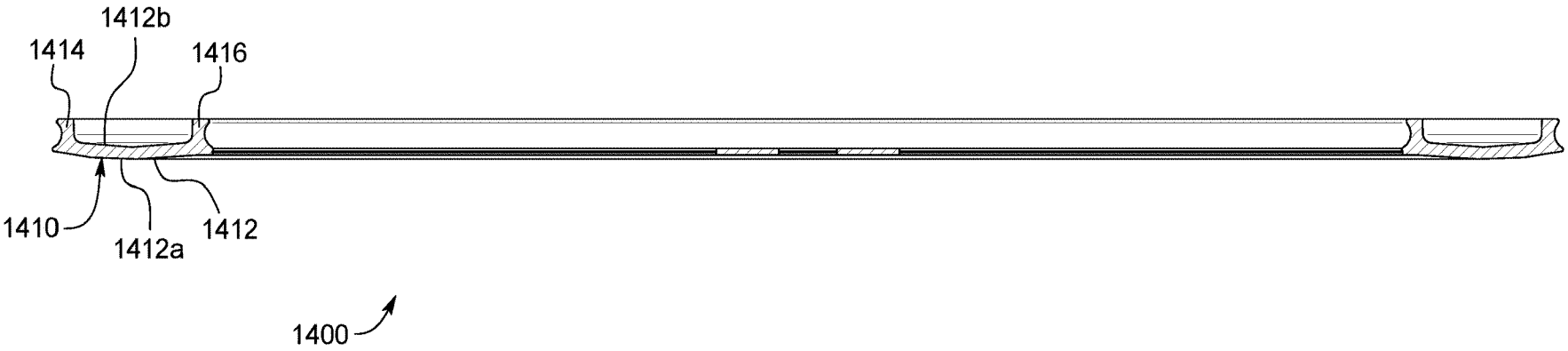
FIG. 16 is an enlarged cross-sectional view of the combined hatch cover protector and gasket of the vented hatch cover assembly of FIG. 11, taken substantially along line 16-16 of FIG. 14.
Figure 19:
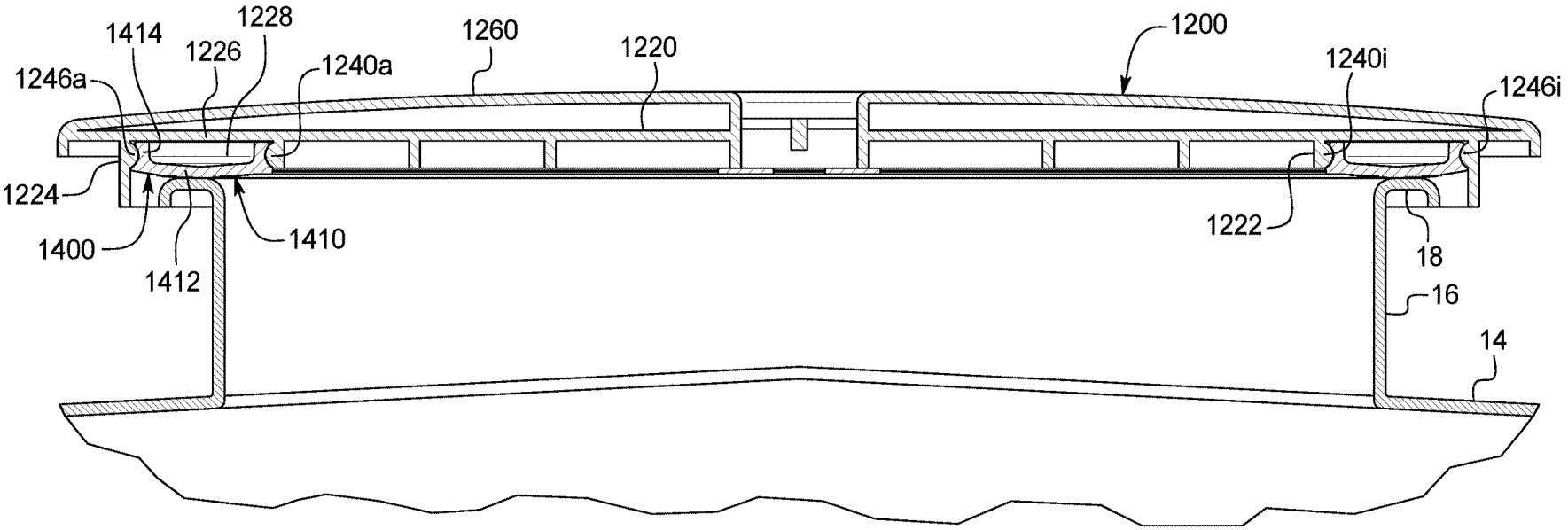
FIG. 19 is a cross-sectional view of the combined hatch cover protector and gasket and the hatch cover of the vented hatch cover assembly of FIG. 11, and partially taken substantially along line 19-19 of FIG. 18 with regard to the hatch cover, and positioned on a coaming extending upwardly from a hopper railroad car roof (shown in fragmentary).
Figure 20:
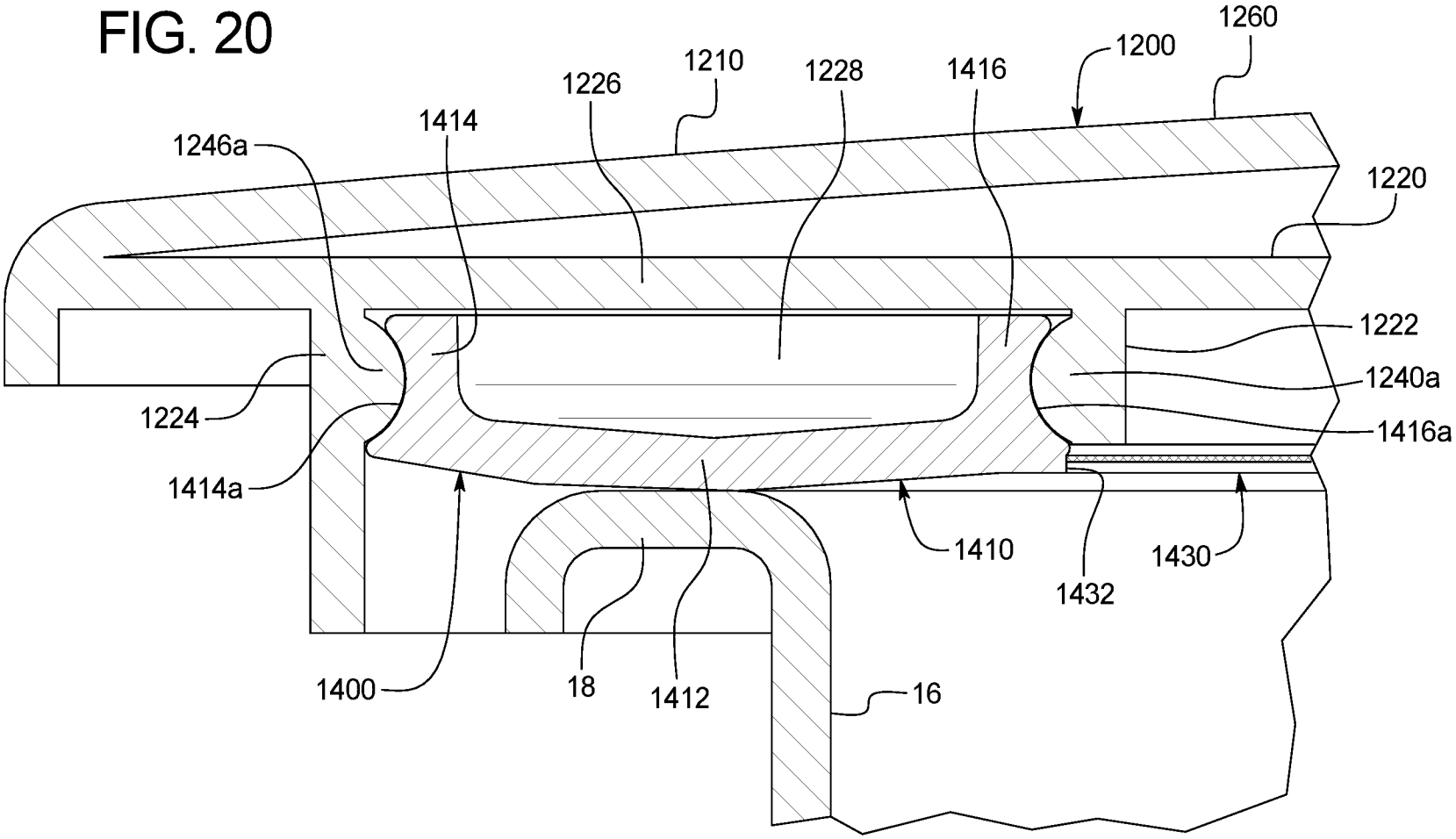
FIG. 20 is an enlarged fragmentary cross-sectional view of part of the combined hatch cover protector and gasket and part of the hatch cover of the vented hatch cover assembly of FIG. 11 positioned on part of a coaming extending upwardly from a hopper railroad car roof (shown in fragmentary).

The combined hatch cover protector and gasket 1400 is configured to be quickly and easily removably attached to the hatch cover 1200 as further described below. The hatch cover 1200 is configured to be attached to the hatch cover securing assembly 1300 in a conventional manner. The hatch cover securing assembly 1300 is configured to be attached to a roof (such as roof 14) of a railroad hopper car in a conventional manner and to move the hatch cover 1200 and the attached combined hatch cover protector and gasket 1400 from: (a) a fully open and unsecured position (not shown) to enable filling of a compartment through a coaming (such as coming 16) to which the vented hatch cover assembly is associated with, to (b) a closed and secured position on that coaming (such as on coming 16) as generally shown in FIGS. 11, 19, and 20. The hatch cover securing assembly 1300 is thus configured to secure the hatch cover 1200 and the attached combined hatch cover protector and gasket 1400 to a respective coaming and to a roof of a hopper railroad car. When the combined hatch cover protector and gasket 1400 is secured to the hatch cover 1200, the combined hatch cover protector and gasket 1400 prevent materials that are being loaded into the hopper railroad car or that are in the hopper railroad car from becoming stuck or lodged in the hatch cover 1200, and thus minimizes potential subsequent contamination of loads carried by the hopper railroad car. Additionally, when the hatch cover 1200 and the combined hatch cover protector and gasket 1400 are secured to the coaming, air in the atmosphere can enter the respective compartment in the hopper railroad car through air intake passages in the hatch cover 1200 and through the combined hatch cover protector and gasket 1400.

Referring now to FIGS. 11, 12, 18, 19, and 20, the hatch cover 1200 includes a body 1210 including a base 1220 and a shell 1260 that define suitable air passages. The base 1220 has a generally circular shape and includes a cylindrical inner rim 1222. The base 1220 includes additional downwardly extending structures (not labeled). The base 1220 further includes a cylindrical outer rim 1224 located radially outward of and spaced apart from the inner rim 1222.

In this illustrated example embodiment, the base 1220 includes a plurality of equally or approximately equally spaced apart inner clips 1240*a*, 2140*b*, 1240*c*, 1240*d*, 1240*e*, 1240*f*, 1240*g*, 1240*h*, 1240*i*, 1240*j* 1240*k*, 1240*l*, 1240*m*, 1240*n*, 1240*o*, and 1240*p* that each extend radially outwardly from the inner rim 1222. In this illustrated example embodiment, each inner clip has convex outer surface. In certain example embodiments, the inner clips all have approximately the same height and approximately the same width. It should be appreciated that quantity of the inner clips can vary and that the shape, size, and spacing of the inner clips may vary in accordance with the present disclosure.

In this illustrated example embodiment, the base 1220 includes a plurality of equally or approximately equally spaced apart outer clips 1246*a*, 1246*b*, 1246*c*, 1246*d*, 1246*e*, and 1246*f*, 1246*g*, 1246*h*, 1246*i*, 1246*j*, 1246*k*, 1246*l*, 1246*m*, 1246*n*, 1246*o*, and 1246*p* that each extend radially inwardly from the outer rim 1224. In this illustrated example embodiment, each outer clip has convex outer surface. In certain example embodiments, the outer clips all have approximately the same height and approximately the same width. It should be appreciated that quantity of the outer clips can vary and that the shape, size, and spacing of the outer clips may vary in accordance with the present disclosure.

Figure 17:
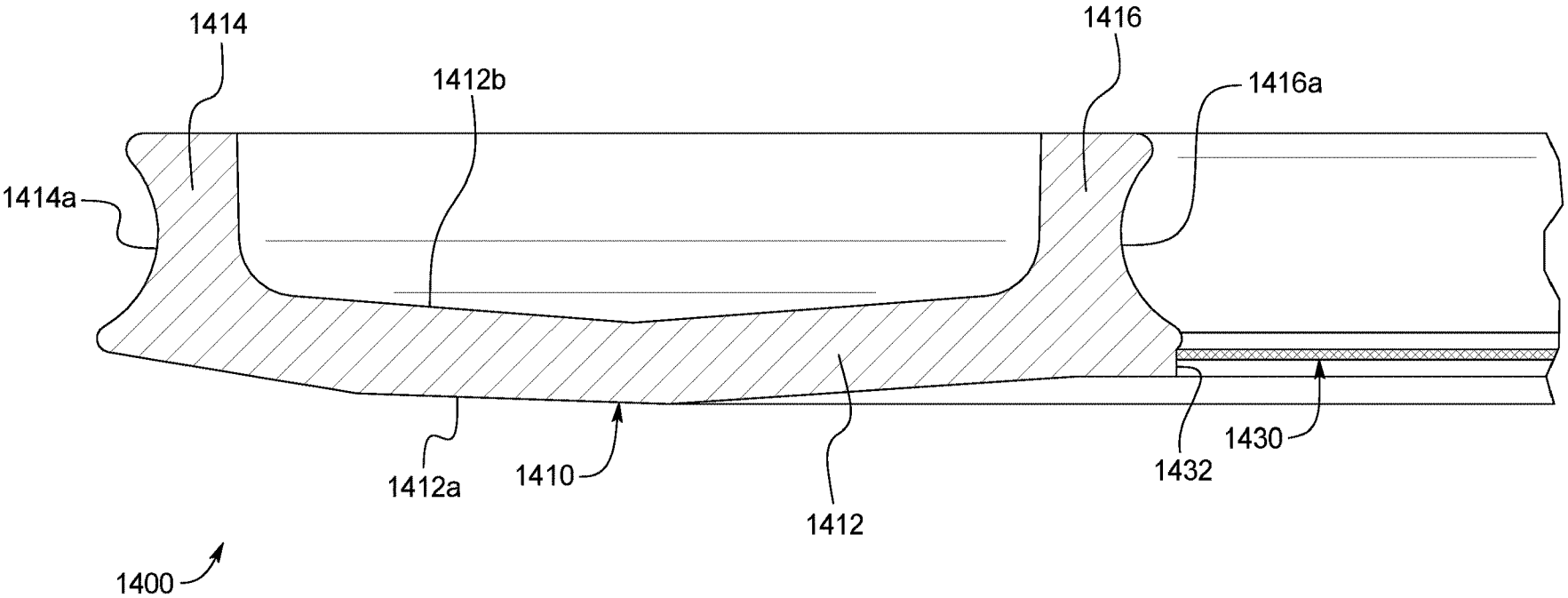
FIG. 17 is an enlarged fragmentary perspective view of part of the combined hatch cover protector and gasket of the vented hatch cover assembly of FIG. 11.
Figure 18:
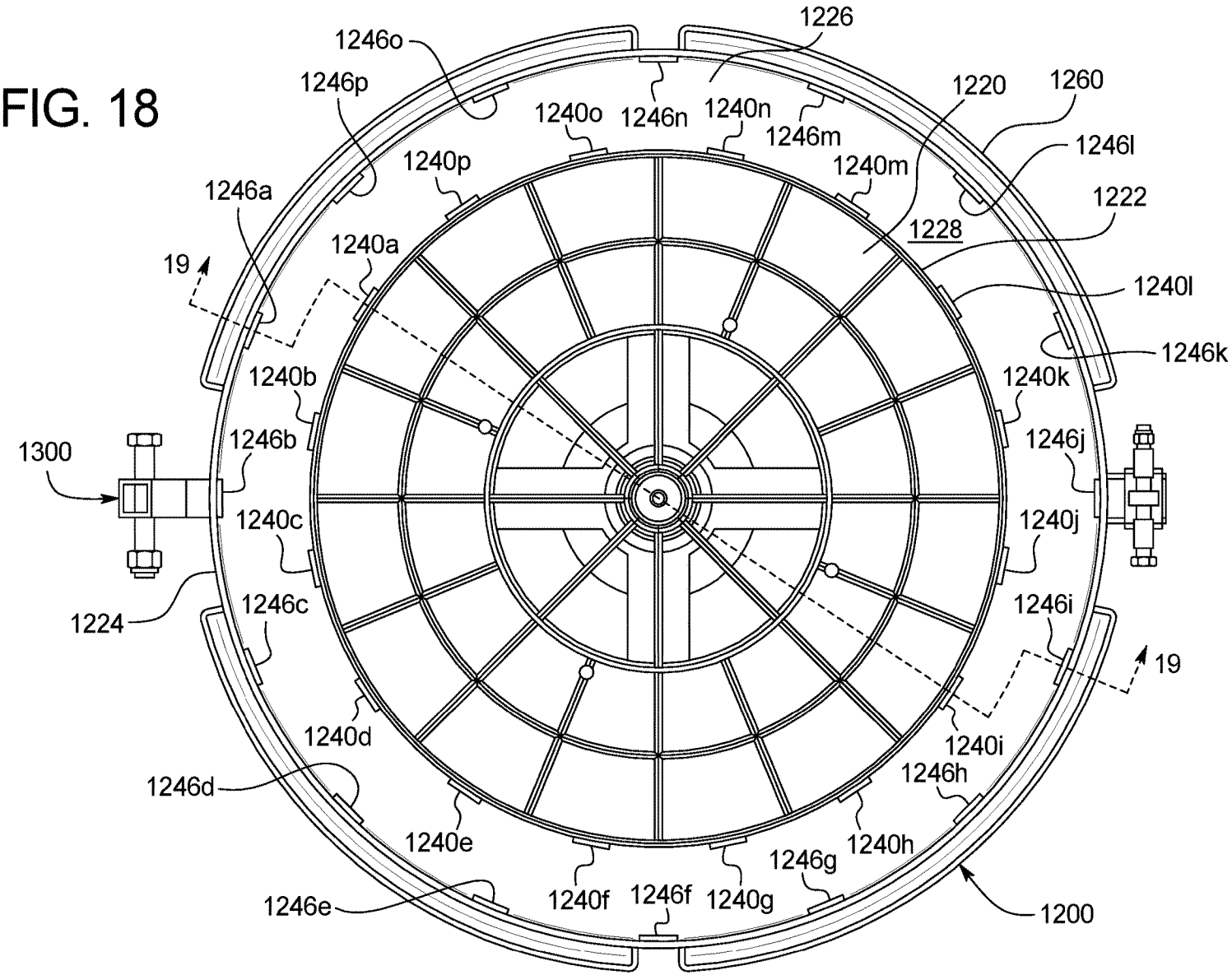
FIG. 18 is an enlarged bottom view of the hatch cover of the vented hatch cover assembly of FIG. 11.

In this illustrated example embodiment, the inner clips and the outer clips are staggered as best shown in FIGS. 11 and 17, although aligned inner and outer clips could also be used for the hatch cover in alternative embodiments of the present disclosure.

The base 1220 includes a ring-shaped or annular seat 1226 connecting the upper end of the outer rim 1224 to the upper end of the inner rim 1222. The seat 1226 is configured to overlie the top of the flange 18 of the coaming 16 when the vented hatch cover assembly 1100 is positioned on the coaming 16 in the closed position as shown in FIGS. 11, 19, and 20. The inner rim 1222, the seat 1226, and the outer rim 1224 define an annular pocket 1228 configured to receive the outer sealing member 1410 of the combined hatch cover protector and gasket 1400 as described below and as shown in FIGS. 19 and 20.

This configuration of the base 1220 and the shell 1260 is further described in U.S. Pat. No. 6,050,199. This configuration provides efficient air flow paths.

In various embodiments, this example hatch cover is made from a acrylonitrile butadiene styrene (commonly called ABS). In various embodiments, the hatch cover includes a UV inhibitor. In various embodiments, the hatch cover includes ABS with a UV inhibitor. The hatch cover can be made using any suitable material(s).

As shown in FIGS. 12 to 17, 19, and 20, the example combined hatch cover protector and gasket 1400 generally includes: (1) an outer sealing member 1410 configured to be positioned in the pocket 1228 and configured to partially function as a gasket that provides a tight seal with the top of the coaming 16; (2) an inner protector element holder 1430; and (3) an air permeable protector element 1450 held by and secured to the inner protector element holder 1430.

In this illustrated example embodiment, the outer sealing member 1410 and the inner protector element holder 1430 are made from a thermoplastic elastomer or other suitable material. In various embodiments of the present disclosure, the outer sealing member 1410 and the inner protector element holder 1430 are integrally formed as a single unit or monolithic unit in part to minimize the ability of loose materials to get attached to or stuck in or to the hatch cover. In various such embodiments, the outer sealing member 1410 and the inner protector element holder 1430 are formed without any seam or joints. In various embodiments, the protector element 1450 is integrally (such as monolithically) connected to the inner protector element holder 1430 without forming any gaps or pockets that can hold loose materials. Thus, the outer sealing member 1410, the inner protector element holder 1430, and the protector element 1450 are formed to minimize contamination issues. The combined hatch cover protector and gasket 1400 is also formed as a one piece unit to facilitate quick and easy installation.

More specifically, the outer sealing member 1410 includes a generally disk-shaped or annular bottom wall 1412 having a bottom sealing surface 1412*a* and a top surface 1412*b*. The outer sealing member 1410 further includes: (1) a generally cylindrical outer wall 1414 connected to and extending upwardly from an outer end (not labeled) of the bottom wall 1412; and (2) a generally cylindrical inner wall 1416 connected to and extending upwardly from an inner end (not labeled) of the bottom wall 1412. This example outer sealing member 1410 does not include the two spaced apart cylindrical lips or flanges 418 and 420 of the above described embodiment, but could alternatively include one or more such lips or flanges in accordance with the present disclosure. Such lips or flanges would be employed to provide a desired amount of additional rigidity for the bottom wall 1412, the sealing surface 1412*a*, and the entire outer sealing member 1410. It should be appreciated that other suitable rigidity adding members can be employed in accordance with the present disclosure. The outer wall 1414 and the inner wall 1416 each include generally flat top edges (not labeled) that are configured to engage the bottom surface of the disk-shaped or annular seat 1226. However, it should be appreciated that these top surfaces may be alternatively formed in accordance with the present disclosure. The bottom surface 1412*a* is somewhat angled toward a center fulcrum (not labeled) and configured to engage a coaming 16 such as the flange 18 of the coaming 16 as shown in FIGS. 19 and 20 when the hatch cover assembly 1100 is in the closed position to provide a weather tight engagement with the coaming 16. In instances where no flange 18 is present, the bottom surface 1412*a* of the bottom wall 1412 of the outer sealing member 1410 is configured to contact the top of the ring shaped coaming 16.

The outer wall 1414 of the outer sealing member 1410 is configured to be engaged by the inwardly extending outer clips 1246*a*, 1246*b*, 1246*c*, 1246*d*, 1246*e*, and 1246*f*, 1246*g*, 1246*h*, 1246*i*, 1246*j*, 1246*k*, 1246*l*, 1246*m*, 1246*n*, 1246*o*, and 1246*p* to removably hold the outer sealing member 1410 in the pocket 1228. In this illustrated example embodiment, the outer wall 1414 includes a concave outer surface 1414*a* that defines an outer annular clip receiving pocket configured to receive the inwardly extending outer clips 1246*a*, 1246*b*, 1246*c*, 1246*d*, 1246*e*, and 1246*f*, 1246*g*, 1246*h*, 1246*i*, 1246*j*, 1246*k*, 1246*l*, 1246*m*, 1246*n*, 1246*o*, and 1246*p*.

Likewise, the inner wall 1416 of the outer sealing member 1410 is configured to be engaged by the outwardly extending inner clips 1240*a*, 2140*b*, 1240*c*, 1240*d*, 1240*e*, 1240*f*, 1240*g*, 1240*h*, 1240*i*, 1240*j* 1240*k*, 1240*l*, 1240*m*, 1240*n*, 1240*o*, and 1240*p* to removably hold the outer sealing member 1410 in the pocket 1228. In this illustrated example embodiment, the inner wall 1416 includes a concave outer surface 1416*a* that defines an inner annular clip receiving pocket configured to receive the outwardly extending inner clips 1240*a*, 2140*b*, 1240*c*, 1240*d*, 1240*e*, 1240*f*, 1240*g*, 1240*h*, 1240*i*, 1240*j* 1240*k*, 1240*l*, 1240*m*, 1240*n*, 1240*o*, and 1240*p*.

The protector element holder 1430 includes a generally disk-shaped or annular outer support 1432 and two protector supporting crossbars 1434 and 1436. Crossbar 1434 extends from a first area of the inner edge (not labeled) of the outer support 1432 to a second area of the inner edge (not labeled) of the outer support 1432 (that is across from or opposite the first area). Crossbar 1434 is connected to the outer support 1432 at both of the first and second areas. Likewise, crossbar 1436 extends from a third area of the inner edge (not labeled) of the outer support 1432 to a fourth area of the inner edge (not labeled) of the outer support 1432 (that is across from or opposite the third area). Crossbar 1436 is connected to the outer support 1432 at both of the third and fourth areas. Crossbar 1434 and crossbar 1436 are connected to each other at a central area (not labeled). The protector element holder 1430, and particularly the outer support 1432 and the crossbars 1434 and 1436 define a frame that has four generally pie shaped protector openings (not labeled). It should be appreciated that the protector element holder can be otherwise suitably configured in accordance with the present disclosure.

The air permeable protector material of the protector element 1450 is suitably attached to the protector element holder 1430, and particularly the outer support 1432 and the crossbars 1434 and 1436 of the inner protector element holder 1430. This attachment may be accomplished in any suitable manner such as but not limited to by over-molding the protector material with the outer support 1432 and the crossbars 1434 and 1436. The protector material may be any suitable material, such as but not limited to a polyester or a woven nylon. The protector material enables air to flow through the combined hatch cover protector and gasket 1400 into the respective compartment of the hopper railroad car while preventing loose materials from getting attached to or stuck in or to various parts of the hatch cover 1200 (i.e., the protector material and the entire combined hatch cover protector and gasket 1400 protect various parts of the hatch cover from the loose materials).

This illustrated example embodiment does not include a dual connector as with the embodiment described above. In this illustrated example embodiment, the protector element holder 1430 is directly integrally (such as monolithically) connected to the bottom wall 1412 of the outer sealing member 1410 of the inner wall 1416 of the outer sealing member 1410.

It should be appreciated from the above that the combined hatch cover protector and gasket 1400 is quickly and easily removably securely attachable to the base 1220 of the hatch cover 1200. More specifically, to attach the combined hatch cover protector and gasket 1400 to the hatch cover 1200, the combined hatch cover protector and gasket 1400 is first aligned with the hatch cover 1200 such that the concave surface 1416*a* of the inner wall 1416 is aligned with the outwardly extending inner clips 1240*a*, 2140*b*, 1240*c*, 1240*d*, 1240*e*, 1240*f*, 1240*g*, 1240*h*, 1240*i*, 1240*j* 1240*k*, 1240*l*, 1240*m*, 1240*n*, 1240*o*, and 1240*p*. The combined hatch cover protector and gasket 1400 is then moved toward the hatch cover 1200 such that each inner clip extends into the annular clip receiving pocket defined by the concave surface 1416*a* of the inner wall 1416. This can be done simultaneously or sequentially. It should be appreciated that the outer sealing member 1410 and specifically at least the wall 1416 are flexible enough to bend outwardly to facilitate this insertion of the outwardly extending inner clips 1240*a*, 2140*b*, 1240*c*, 1240*d*, 1240*e*, 1240*f*, 1240*g*, 1240*h*, 1240*i*, 1240*j* 1240*k*, 1240*l*, 1240*m*, 1240*n*, 1240*o*, and 1240*p* into the annular clip receiving pocket defined by the concave surface 1416*a* of the inner wall 1416. With all of the inner clips 1240*a*, 2140*b*, 1240*c*, 1240*d*, 1240*e*, 1240*f*, 1240*g*, 1240*h*, 1240*i*, 1240*j* 1240*k*, 1240*l*, 1240*m*, 1240*n*, 1240*o*, and 1240*p* situated in this annular clip receiving pocket, the combined hatch cover protector and gasket 1400 is partially secured to the hatch cover 1200.

To further and fully attach the combined hatch cover protector and gasket 1400 to the hatch cover 1200, the wall 1414 of the outer sealing member 1410 is flexed inwardly such that the inwardly extending outer clips 1246*a*, 1246*b*, 1246*c*, 1246*d*, 1246*e*, and 1246*f*, 1246*g*, 1246*h*, 1246*i*, 1246*j*, 1246*k*, 1246*l*, 1246*m*, 1246*n*, 1246*o*, and 1246*p* extend into the annular clip receiving pocket defined by the concave surface 1414*a* of the outer wall 1414. This can be done simultaneously or sequentially. After doing so, the inwardly extending outer clips 1246*a*, 1246*b*, 1246*c*, 1246*d*, 1246*e*, and 1246*f*, 1246*g*, 1246*h*, 1246*i*, 1246*j*, 1246*k*, 1246*l*, 1246*m*, 1246*n*, 1246*o*, and 1246*p* each engage the concave surface 1414*a* of the outer wall 1414 of the outer sealing member 1410 to maintain the outer sealing 1410 in the pocket 1228 as partially shown in FIGS. 19 and 20. The attachment of the combined hatch cover protector and gasket 1400 in this manner thus positions outer sealing member 1410 of the combined hatch cover protector and gasket 1400 in the pocket 1228.

Whenever necessary, the combined hatch cover protector and gasket 1400 can be removed from the hatch cover 1200 for cleaning and/or replacement by reversing this installation process.

It should be appreciated that, when attached to the base 1220 of the hatch cover 1200, the combined hatch cover protector and gasket 1400 and particularly part of the inner protector element holder 1430 and the protector element 1450 are disposed under the air passages such that the protector element 1450 is in the flow path of the air exiting the air passages and flowing into the compartment. The inner protector element 1450 allows air to flow through it into the compartment. The inner protector element 1450 also functions in part to prevent or reduce contaminants from entering the interior compartment of the hopper railroad car through these passageways. The inner protector element 1450 also minimizes the ability of loose materials from getting attached to or stuck in or to the hatch cover 1200 and thus minimizes the above described potential contamination issues.

It will be understood that modifications and variations may be effected without departing from the scope of the novel concepts of the present invention, and it is understood that this application is to be limited only by the scope of the claims.

The invention claimed is:

1. A railroad car combined hatch cover protector and gasket comprising:

an annular outer sealing member configured to be positioned in an annular pocket of a hatch cover and configured to engage a coaming upwardly extending from a roof of a hopper railroad car;

an inner protector element holder;

a protector element secured to the inner protector element holder; and a cylindrical dual connector integrally connecting the annular outer sealing member and the inner protector element holder, and configured to facilitate connection to the hatch cover, wherein the outer sealing member, the inner protector element holder, and the dual connector form a monolithic one-piece combined hatch cover protector and gasket component.

2. The railroad car combined hatch cover protector and gasket of claim 1, wherein the outer sealing member includes an annular bottom wall configured to engage the coaming of the hopper railroad car, a cylindrical outer wall connected to and extending upwardly from an outer end of the bottom wall, and a cylindrical inner wall connected to and extending upwardly from an inner end of the bottom wall.

3. The railroad car combined hatch cover protector and gasket of claim 2, wherein the outer sealing member includes two spaced apart cylindrical flanges connected to and extending upwardly from the annular bottom wall.

4. The railroad car combined hatch cover protector and gasket of claim 1, wherein the protector element holder includes an annular outer support and a protector supporting crossbar.

5. The railroad car combined hatch cover protector and gasket of claim 1, wherein the protector element holder includes an annular outer support and intersecting protector supporting crossbars.

6. The railroad car combined hatch cover protector and gasket of claim 5, wherein the annular outer support and the intersecting protector supporting crossbars define four generally pie shaped protector openings.

7. The railroad car combined hatch cover protector and gasket of claim 1, wherein protector material of the protector element is one of a polyester and a woven nylon.

8. The railroad car combined hatch cover protector and gasket of claim 1, wherein the cylindrical dual connector includes a cylindrical upright wall having a top end integrally connected to a bottom wall of the outer sealing member and a bottom end integrally connect to an outer end of the outer support of the protector element holder.

9. The railroad car combined hatch cover protector and gasket of claim 1, wherein the cylindrical dual connector connects the outer sealing member and the protector material holder at different levels.

10. The railroad car combined hatch cover protector and gasket of claim 1, wherein the cylindrical dual connector defines spaced apart clip receiving slots configured to respectively receive clips outwardly extending from an inner rim of the hatch cover.

11. The railroad car combined hatch cover protector and gasket of claim 1, wherein the outer sealing member, the inner protector element holder, and the dual connector are made from a polymer.

12. The railroad car combined hatch cover protector and gasket of claim 11, wherein the outer sealing member, the inner protector element holder, and the dual connector are made from a thermoplastic elastomer and form the monolithic one-piece combined hatch cover protector and gasket component, wherein the monolithic one-piece combined hatch cover protector and gasket component is removably attachable to the annular pocket of the hatch cover so as to engage the coaming upwardly extending from the roof of the hopper railroad car.

13. A railroad car combined hatch cover protector and gasket comprising:

an annular outer sealing member configured to be positioned in an annular pocket of a hatch cover, the outer sealing member including an annular bottom wall configured to engage a coaming upwardly extending from a roof of a hopper railroad car, a cylindrical outer wall connected to and extending upwardly from an outer end of the bottom wall, and a cylindrical inner wall connected to and extending upwardly from an inner end of the bottom wall;

an inner protector element holder including an annular outer support and a protector supporting crossbar;

a protector element secured to the protector element holder; and a dual connector including a cylindrical upright wall having a top end integrally connected to the bottom wall of the outer sealing member and a bottom end integrally connected to an outer end of the outer support of the inner protector element holder, the dual connector defining spaced apart clip receiving slots configured to respectively receive clips outwardly extending from an inner rim of the hatch cover to facilitate connection to the hatch cover, wherein the outer sealing member, the inner protector element holder, and the dual connector are made from a thermoplastic elastomer and form a monolithic one-piece combined hatch cover protector and gasket component.

14. The railroad car combined hatch cover protector and gasket of claim 13, wherein the outer sealing member includes two spaced apart annular flanges connected to and extending upwardly from the bottom wall of the outer sealing member.

15. The railroad car combined hatch cover protector and gasket of claim 13, wherein the protector element holder includes intersecting protector supporting crossbars.

16. The railroad car combined hatch cover protector and gasket of claim 13, wherein the dual connector connects the outer sealing member and the protector material holder at different levels.

17. The railroad car combined hatch cover protector and gasket of claim 13, wherein the outer sealing member, the inner protector element holder, and the dual connector are made from a polymer.

18. The railroad car combined hatch cover protector and gasket of claim 17, wherein the outer sealing member, the inner protector element holder, and the dual connector are made from a thermoplastic elastomer and form the monolithic one-piece combined hatch cover protector and gasket component, wherein the monolithic one-piece combined hatch cover protector and gasket component is removably attachable to the annular pocket of the hatch cover so as to engage the coaming upwardly extending from the roof of the hopper railroad car.

19. A railroad car combined hatch cover protector and gasket comprising:

an annular outer sealing member configured to be positioned in an annular pocket of a hatch cover and configured to engage a coaming upwardly extending from a roof of a hopper railroad car;

an inner protector element holder integrally connected to the annular outer sealing member; and a protector element secured to the inner protector element holder, wherein the outer sealing member and the inner protector element holder form a monolithic one-piece combined hatch cover protector and gasket component.

20. The railroad car combined hatch cover protector and gasket of claim 19, wherein the outer sealing member includes an annular bottom wall configured to engage the coaming, a cylindrical outer wall connected to and extending upwardly from an outer end of the bottom wall, and a cylindrical inner wall connected to and extending upwardly from an inner end of the bottom wall.

21. The railroad car combined hatch cover protector and gasket of claim 20, wherein the cylindrical inner wall includes an outer concave surface that defines a clip receiving pocket configured to respectively receive clips outwardly extending from an inner rim of a hatch cover.

22. The railroad car combined hatch cover protector and gasket of claim 21, wherein the cylindrical outer wall includes an outer concave surface that defines a clip receiving pocket configured to respectively receive clips inwardly extending from an outer rim of the hatch cover.

23. The railroad car combined hatch cover protector and gasket of claim 19, wherein the cylindrical outer wall includes an outer concave surface that defines a clip receiving pocket configured to respectively receive clips inwardly extending from an outer rim of a hatch cover.

24. The railroad car combined hatch cover protector and gasket of claim 19, wherein protector material of the protector element is one of a polyester and a woven nylon.

25. The railroad car combined hatch cover protector and gasket of claim 19, wherein the outer sealing member and the inner protector element holder are made from a polymer.

26. The railroad car combined hatch cover protector and gasket of claim 25, wherein the outer sealing member and the inner protector element holder are made from a thermoplastic elastomer and form the monolithic one-piece combined hatch cover protector and gasket component, wherein the monolithic one-piece combined hatch cover protector and gasket component is removably attachable to the annular pocket of the hatch cover so as to engage the coaming upwardly extending from the roof of the hopper railroad car.

27. A railroad car combined hatch cover protector and gasket comprising:

an annular outer sealing member configured to be positioned in an annular pocket of a hatch cover, the outer sealing member including an annular bottom wall configured to engage a coaming upwardly extending from a roof of a hopper railroad car, a cylindrical outer wall connected to and extending upwardly from an outer end of the bottom wall, and a cylindrical inner wall connected to and extending upwardly from an inner end of the bottom wall, wherein the outer wall includes a concave surface defining a first clip receiving pocket, and the inner wall includes a concave surface defining a second clip receiving pocket;

an inner protector element holder integrally connected to the annular outer sealing member and including an annular outer support and a protector supporting crossbar; and a protector element secured to the protector element holder, wherein the outer sealing member and the inner protector element holder form a monolithic one-piece combined hatch cover protector and gasket component.

28. The railroad car combined hatch cover protector and gasket of claim 27, wherein the outer sealing member includes an annular flange connected to and extending upwardly from the bottom wall of the outer sealing member.

29. The railroad car combined hatch cover protector and gasket of claim 28, wherein the protector element holder includes intersecting protector supporting crossbars.

30. The railroad car combined hatch cover protector and gasket of claim 29, wherein the outer sealing member and the inner protector element holder are made from a polymer.

31. The railroad car combined hatch cover protector and gasket of claim 30, wherein the outer sealing member and the inner protector element holder are made from a thermoplastic elastomer and form the monolithic one-piece combined hatch cover protector and gasket component, wherein the monolithic one-piece combined hatch cover protector and gasket component is removably attachable to the annular pocket of the hatch cover so as to engage the coaming upwardly extending from the roof of the hopper railroad car.

* * * * *